US012091214B2

(12) United States Patent
Carmody

(10) Patent No.: US 12,091,214 B2
(45) Date of Patent: Sep. 17, 2024

(54) FLUID CONTAINERS AND FLUID CONTAINER SYSTEMS

(71) Applicant: CarmodyIP LLC, Blissfield, MI (US)

(72) Inventor: Matthew Shane Carmody, Blissfield, MI (US)

(73) Assignee: CarmodyIP LLC, Blissfield, MI (US)

( * ) Notice: Subject to any disclaimer, the term of this patent is extended or adjusted under 35 U.S.C. 154(b) by 249 days.

(21) Appl. No.: 17/887,825

(22) Filed: Aug. 15, 2022

(65) Prior Publication Data

US 2022/0388723 A1 Dec. 8, 2022

Related U.S. Application Data

(63) Continuation of application No. 16/788,350, filed on Feb. 12, 2020, now Pat. No. 11,414,239, which is a continuation of application No. 16/451,685, filed on Jun. 25, 2019, now Pat. No. 10,562,673, which is a continuation of application No. 15/249,698, filed on Aug. 29, 2016, now abandoned.

(51) Int. Cl.

| | |
|---|---|
| ***B65D 25/24*** | (2006.01) |
| ***B65D 21/02*** | (2006.01) |
| ***B65D 25/38*** | (2006.01) |
| ***B65D 43/02*** | (2006.01) |
| ***B65D 77/06*** | (2006.01) |

(52) U.S. Cl.

CPC ..... *B65D 25/24* (2013.01); *B65D 21/0209* (2013.01); *B65D 21/0219* (2013.01); *B65D 25/38* (2013.01); *B65D 43/02* (2013.01); *B65D 77/06* (2013.01); *B65D 77/061* (2013.01); *B65D 2231/008* (2013.01)

(58) Field of Classification Search

CPC ..... B65D 25/24; B65D 21/0209; B65D 21/0219; B65D 25/38; B65D 43/02; B65D 77/06; B65D 77/061; B65D 2231/008; B67D 3/0067; B67D 3/008; B67D 3/0083

USPC ..... 222/185.1

See application file for complete search history.

(56) References Cited

U.S. PATENT DOCUMENTS

| | | | |
|---|---|---|---|
| 1,396,053 | A | 11/1921 | Wheeler |
| 1,631,802 | A | 6/1927 | Evert |
| 2,072,185 | A | 3/1937 | Schein |
| 2,721,006 | A | 10/1955 | Knutsen |

(Continued)

FOREIGN PATENT DOCUMENTS

WO 2007055692 A1 5/2007

OTHER PUBLICATIONS

Home Hydro Systems, "Ebb and Flow—(Flood and Drain) System," [retrieved on Aug. 10, 2015]. Retrieved from the Internet: <URL: http://homehydrosystems.com/hyrdoponic-systems/ebb-flow_systems.html>.

(Continued)

*Primary Examiner* — Vishal Pancholi

(74) *Attorney, Agent, or Firm* — MacMillan, Sobanski & Todd, LLC

(57) ABSTRACT

An example fluid container includes a main body and a support leg. The main body has a bottom wall and a sidewall that extends from the bottom wall. The bottom wall has a bottom wall first internal surface and the sidewall has a sidewall first portion, a sidewall second portion, and defines a passageway. The bottom wall first internal surface extends from the sidewall second portion toward the passageway at a downward slope. The support leg extends from the main body and is sized and configured to support the fluid container.

20 Claims, 24 Drawing Sheets

(56) References Cited

U.S. PATENT DOCUMENTS

| | | | |
|---|---|---|---|
| 2,831,610 | A | 4/1958 | Dennie |
| 2,887,251 | A | 5/1959 | James |
| 2,983,076 | A | 5/1961 | Merrill |
| 3,001,500 | A | 9/1961 | Hawthrone et al. |
| 3,001,501 | A | 9/1961 | Hawthrone et al. |
| 3,112,047 | A | 11/1963 | Weinreich |
| 3,221,943 | A | 12/1965 | Anderson |
| 3,239,104 | A | 3/1966 | Scholle |
| 3,325,058 | A | 6/1967 | West |
| 3,374,726 | A | 3/1968 | Takayanagi |
| 3,713,839 | A | 1/1973 | Delente et al. |
| 3,729,321 | A | 4/1973 | Vacano |
| 3,837,533 | A | 9/1974 | Splan |
| 3,910,173 | A | 10/1975 | Zepponi |
| 4,077,159 | A | 3/1978 | Haglund |
| 4,201,484 | A | 5/1980 | Sasiela et al. |
| 4,300,311 | A | 11/1981 | Marchant |
| 4,441,407 | A | 4/1984 | Rieger |
| 4,474,890 | A | 10/1984 | Rieger |
| 4,603,506 | A | 8/1986 | Powell, Jr. |
| 4,660,733 | A | 4/1987 | Snyder et al. |
| 4,673,125 | A | 6/1987 | Weaver |
| 4,765,360 | A | 8/1988 | Baird |
| 5,054,233 | A | 10/1991 | Evans |
| 5,062,239 | A | 11/1991 | Helton |
| 5,186,359 | A | 2/1993 | Brown et al. |
| 5,356,029 | A | 10/1994 | Hogan |
| 5,445,289 | A | 8/1995 | Owen |
| 5,673,823 | A | 10/1997 | Hanks et al. |
| 5,860,247 | A | 1/1999 | Newby |
| 5,890,616 | A | 4/1999 | Cravens et al. |
| 5,983,564 | A | 11/1999 | Stragnola |
| 6,047,499 | A | 4/2000 | Staas |
| 6,158,623 | A | 12/2000 | Benavides et al. |
| 6,279,265 | B1 | 8/2001 | Scannell, Jr. |
| 6,286,700 | B1 | 9/2001 | Davidson |
| 6,454,134 | B1 | 9/2002 | Aujesky et al. |
| 6,703,055 | B1 | 3/2004 | Klein et al. |
| 6,837,147 | B2 | 1/2005 | Daniel |
| 7,093,391 | B2 | 8/2006 | Eakin |
| 7,370,605 | B2 | 5/2008 | Meritt |
| 7,377,420 | B2 | 5/2008 | Gardner |
| 7,412,798 | B2 | 8/2008 | Boxsell |
| 8,567,627 | B2 | 10/2013 | Schmider |
| 8,726,568 | B2 | 5/2014 | Wilson et al. |
| 8,875,934 | B2 | 11/2014 | Deka |
| 8,915,016 | B2 | 12/2014 | Wilson et al. |
| 9,258,953 | B2 | 2/2016 | Wilson et al. |
| 9,277,696 | B2 | 3/2016 | Wilson et al. |
| 9,332,695 | B2 | 5/2016 | Hwang |
| 10,562,673 | B2 | 2/2020 | Carmody |
| 11,414,239 | B2 | 8/2022 | Carmody |
| 2001/0052199 | A1 | 12/2001 | Klein et al. |
| 2002/0017058 | A1 | 2/2002 | Chung |
| 2003/0145519 | A1 | 8/2003 | Winsbury |
| 2003/0155372 | A1 | 8/2003 | Yorn et al. |
| 2005/0204620 | A1 | 9/2005 | Butterfield et al. |
| 2006/0168883 | A1 | 8/2006 | Brutsche, III et al. |
| 2006/0272211 | A1 | 12/2006 | Motelow |
| 2006/0277825 | A1 | 12/2006 | Sanders |
| 2007/0084109 | A1 | 4/2007 | Brister |
| 2007/0145072 | A1 | 6/2007 | Cook et al. |
| 2008/0155896 | A1 | 7/2008 | Chen |
| 2008/0156827 | A1 | 7/2008 | Alberto |
| 2009/0236369 | A1 | 9/2009 | Lin |
| 2010/0071255 | A1 | 3/2010 | Zilbershlag |
| 2010/0200613 | A1 | 8/2010 | Smith |
| 2011/0232190 | A1 | 9/2011 | Pindus et al. |
| 2011/0239537 | A1 | 10/2011 | Lee et al. |
| 2011/0283612 | A1 | 11/2011 | Law et al. |
| 2012/0005957 | A1 | 1/2012 | Downs, Sr. |
| 2012/0085026 | A1 | 4/2012 | Morris |
| 2012/0196016 | A1 | 8/2012 | Palmer |
| 2012/0234864 | A1 | 9/2012 | Liu |
| 2013/0067814 | A1 | 3/2013 | Riley et al. |
| 2013/0118074 | A1 | 5/2013 | Fulbrook |
| 2014/0026480 | A1 | 1/2014 | Lenhart, Jr. et al. |
| 2014/0075841 | A1 | 3/2014 | Degraff |
| 2014/0291356 | A1 | 10/2014 | Schutz |
| 2014/0326327 | A1 | 11/2014 | Owen et al. |
| 2015/0122844 | A1 | 5/2015 | Klein et al. |
| 2015/0147433 | A1 | 5/2015 | Singh |
| 2015/0250108 | A1 | 9/2015 | Haas |
| 2015/0284181 | A1 | 10/2015 | Sullinger et al. |
| 2015/0289453 | A1 | 10/2015 | Lewis et al. |
| 2015/0351339 | A1 | 12/2015 | Carmody |
| 2016/0272477 | A1 | 9/2016 | Bellmore et al. |
| 2016/0297667 | A1 | 10/2016 | Mottaz et al. |

OTHER PUBLICATIONS

Hydro Farm, "Active Aqua," [retrieved on Aug. 1, 2016]. Retrieved from the Internet: <URL: http://www.hydrofarm.com/our-brands/active-aqua>.

Esoteric Hydroponics, "The HyperPod System—aka 'The Predator' by Esoteric Hydroponics," [retrieved on Aug. 10, 2015]. Retrieved from the Internet: <URL: http://www.1-hydroponics.co.uk/hydroponic-systems/esoteric-hydroponic-systems/hyperpod/the-hyper-pod™-system-aka-"the-predator".html>.

FLUID CONTAINERS AND FLUID CONTAINER SYSTEMS

CROSS-REFERENCE TO RELATED APPLICATIONS

This application is a continuation of U.S. Nonprovisional application Ser. No. 16/788,350, filed Feb. 12, 2020, which is a continuation of U.S. Nonprovisional application Ser. No. 16/451,685, filed Jun. 25, 2019, which is a continuation of U.S. Nonprovisional application Ser. No. 15/249,698, filed Aug. 29, 2016. The entire disclosure of each of these related applications is hereby incorporated into this disclosure by reference.

FIELD

The disclosure relates generally to the field of fluid containers. More particularly, the disclosure relates to fluid containers, fluid container systems, methods of using a fluid container, and kits that include a fluid container.

BACKGROUND

Typically, fluid containers are used to store a fluid or material, which can be emptied from the container by manually lifting and tilting the container or by using a drain on the fluid container. For example, if the fluid container is a multiple use container, it is desirable to remove any fluid or material stored in the container before the container is cleaned. Currently, fluid containers that include drains for removing any fluid or material disposed within the container fail to provide adequate drainage of the fluid or material being stored within the container and require a user to lift or tilt the container to effectuate complete drainage. The structural arrangements of the these containers create pockets of fluid and/or material at the bottom of the container, which increases the time required to clean the containers and decreases the extent of drainage that a user can achieve without lifting or tilting the container.

Therefore, a need exists for new and useful fluid containers, fluid container systems, and associated methods and kits.

SUMMARY OF SELECTED EXAMPLE EMBODIMENTS

Various fluid containers, fluid container systems, methods of using a fluid container, and kits that include a fluid container are described herein.

An example fluid container comprises a main body and a support leg. The main body has a bottom wall and a sidewall. The bottom wall has a bottom wall first internal surface. The sidewall extends from the bottom wall and has a sidewall first internal surface, a sidewall second internal surface, and defines a passageway that extends through the sidewall first internal surface. The sidewall first internal surface is disposed at a first angle relative to the bottom wall first internal surface. The sidewall second internal surface is disposed at a second angle relative to the bottom wall first internal surface that is different than the first angle. The bottom wall first internal surface extends from the sidewall second internal surface toward the passageway at a downward slope. The bottom wall and the sidewall cooperatively define a fluid holding cavity that is in fluid communication with the passageway. The support leg extends from the main body and is sized and configured to support said fluid container.

An example fluid container system comprises a fluid container and a valve. The fluid container has a main body and a support leg. The main body has a bottom wall and a sidewall. The bottom wall has a bottom wall first internal surface. The sidewall extends from the bottom wall and has a sidewall first internal surface, a sidewall second internal surface, and defines a passageway that extends through the sidewall first internal surface. The sidewall first internal surface is disposed at a first angle relative to the bottom wall first internal surface. The sidewall second internal surface is disposed at a second angle relative to the bottom wall first internal surface that is different than the first angle. The bottom wall first internal surface extends from the sidewall second internal surface toward the passageway and the sidewall first internal surface at a downward slope. The bottom wall and sidewall cooperatively define a recess that extends into the main body such that the passageway is in fluid communication with the recess. The bottom wall and the sidewall cooperatively define a fluid holding cavity that is in fluid communication with the passageway. The support leg extends from the main body and is sized and configured to support said fluid container. The valve is attached to the fluid container and is in fluid communication with the passageway. The valve is movable between an open configuration in which the passageway is open and unobstructed and a closed configuration in which the valve obstructs the passageway.

Another example fluid container system comprises a fluid container and a valve. The fluid container has a main body and a support leg. The main body has a bottom wall and a sidewall. The bottom wall has a bottom wall first internal surface, a bottom wall second internal surface, a bottom wall third internal surface, a bottom wall fourth internal surface, and a bottom wall fifth internal surface. The bottom wall first internal surface is disposed between the bottom wall second internal surface and the bottom wall third internal surface. The bottom wall second internal surface is disposed between the bottom wall fourth internal surface and the bottom wall first internal surface. The bottom wall third internal surface is disposed between the bottom wall fifth internal surface and the bottom wall first internal surface. The bottom wall first internal surface, the bottom wall second internal surface, and the bottom wall third internal surface cooperatively define a channel. The sidewall extends from the bottom wall and has a sidewall first internal surface, a sidewall second internal surface, and defines a passageway that extends through the sidewall first internal surface. The sidewall first internal surface is disposed at a first angle relative to the bottom wall first internal surface. The sidewall second internal surface is disposed at a second angle relative to the bottom wall first internal surface. The first angle is less than 90 degrees. The second angle is greater than 90 degrees. The bottom wall first internal surface extends from the sidewall second internal surface toward the passageway and the sidewall first internal surface at a downward slope. The bottom wall and sidewall cooperatively define a recess that extends into the main body such that the passageway is in fluid communication with the recess. The bottom wall and the sidewall cooperatively define a fluid holding cavity that is in fluid communication with the passageway. The support leg extends from the main body and is sized and configured to support said fluid container. The valve is attached to the fluid container and is in fluid communication with the passageway. The valve is movable between an open configuration in which the passageway is open and unobstructed and a closed configuration in which the valve obstructs the passageway.

Another example fluid container system comprises a fluid container, a valve, a lid, and a liner. The fluid container comprises a main body and a support leg. The main body has a bottom wall and a sidewall. The bottom wall has a bottom wall first internal surface. The sidewall extends from the bottom wall and has a sidewall first internal surface, a sidewall second internal surface, and defines a passageway that extends through the sidewall first internal surface. The sidewall first internal surface is disposed at a first angle relative to the bottom wall first internal surface. The sidewall second internal surface is disposed at a second angle relative to the bottom wall first internal surface that is different than the first angle. The bottom wall first internal surface extends from the sidewall second internal surface toward the passageway at a downward slope. The bottom wall and the sidewall cooperatively define a fluid holding cavity that is in fluid communication with the passageway. The support leg extends from the main body and is sized and configured to support said fluid container. The valve is attached to the fluid container and is in fluid communication with the passageway. The valve is movable between an open configuration in which the passageway is open and unobstructed and a closed configuration in which the valve obstructs the passageway. The lid is releasably attached to the fluid container. The liner is partially disposed within the fluid holding container and between the fluid container and the lid.

An example method of using a fluid container comprises the steps of: selecting a first fluid container system; selecting a second fluid container system; attaching the first fluid container system to the second fluid container system using a tubular member such that the fluid holding cavities of each fluid container system is in communication with the passageway defined by the tubular member; positioning an end of the tubular member over a drain; introducing a fluid into the first fluid container, introducing a fluid into the second fluid container, allowing an interval of time to pass; removing the fluid from the first fluid container system; and removing the fluid from the second fluid container system.

An example kit that includes a fluid container comprises a fluid container according to an embodiment; a valve according to an embodiment; a lid according to an embodiment; a liner according to an embodiment; an attachment screw according to an embodiment; and instructions for use.

Additional understanding of the example fluid containers, fluid container systems, methods of using a fluid container, and kits that include a fluid container can be obtained by review of the detailed description, below, and the appended drawings.

DETAILED DESCRIPTION

Figure 1:
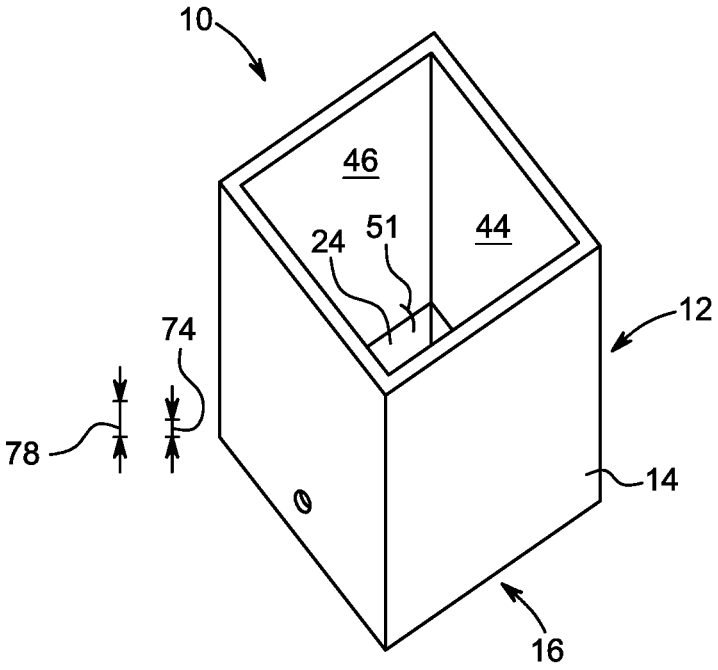
FIG. 1 is a perspective view of a first example fluid container.
Figure 2:
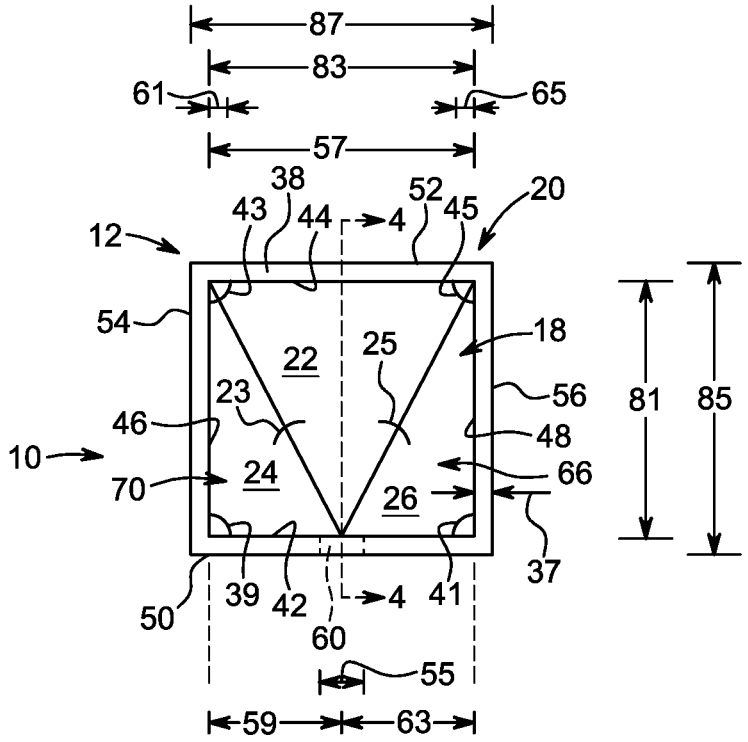
FIG. 2 is a top view of the fluid container illustrated in FIG. 1.
Figure 3:
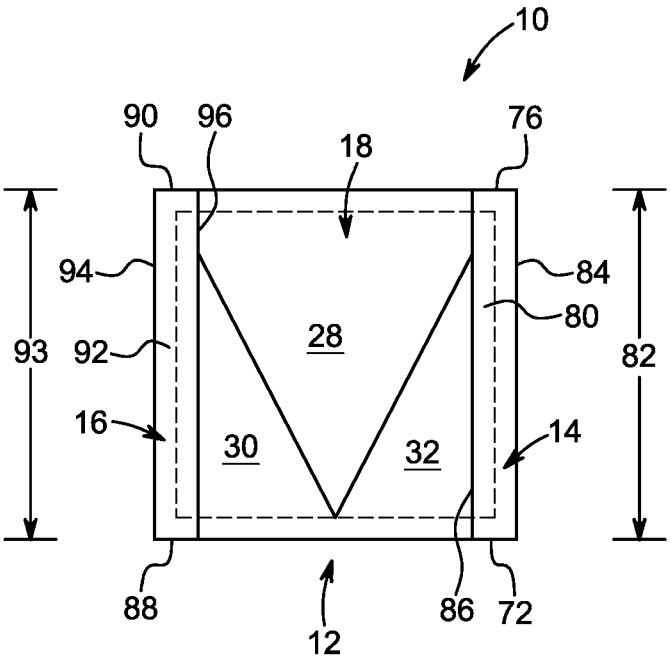
FIG. 3 is a bottom view of the fluid container illustrated in FIG. 1.
Figure 4:
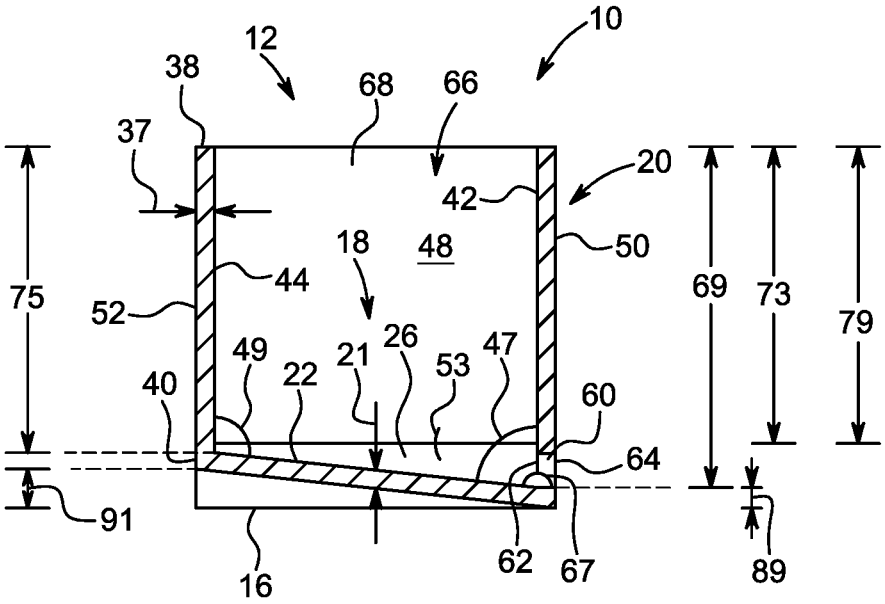
FIG. 4 is a sectional view of the fluid container illustrated in FIG. 2 taken alone line 4-4.
Figure 5:
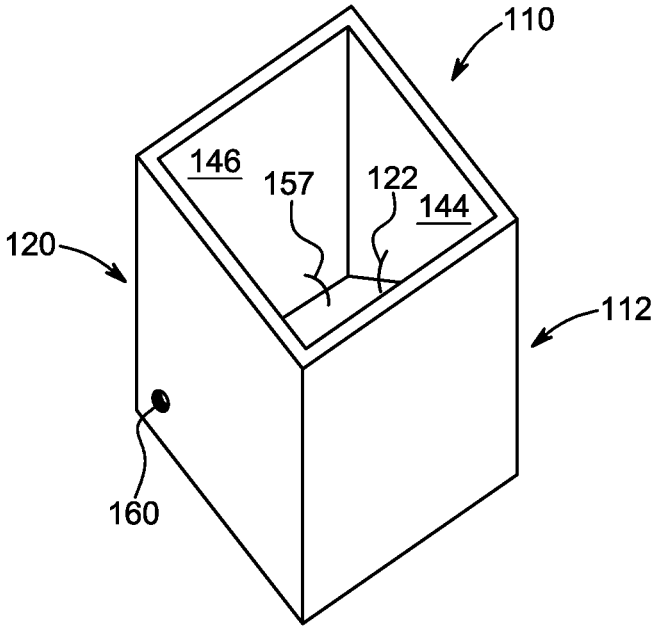
FIG. 5 is a perspective view of second example fluid container.
Figure 6:
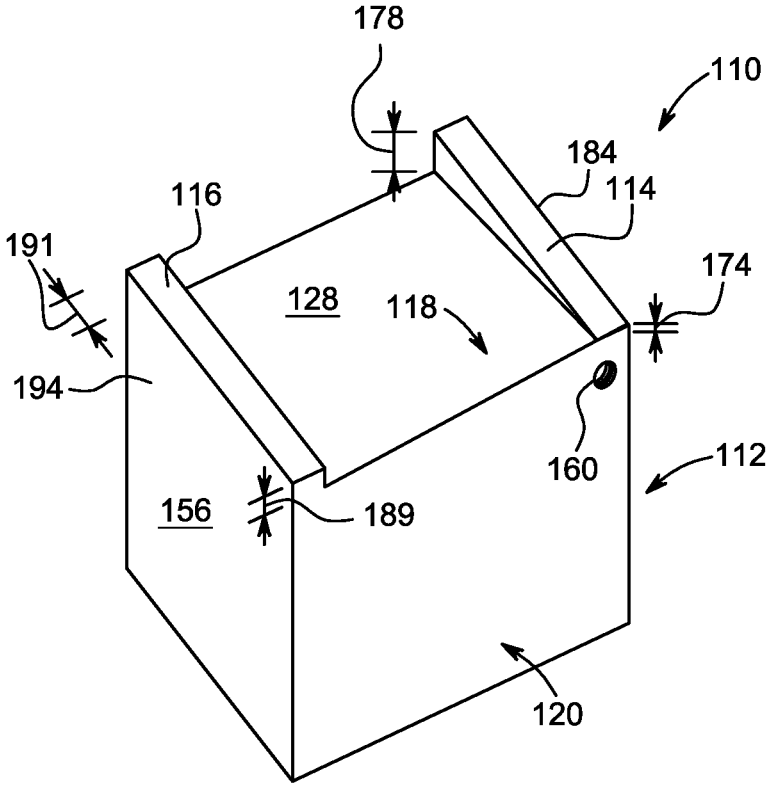
FIG. 6 is another perspective view of the fluid container illustrated in FIG. 5.
Figure 7:
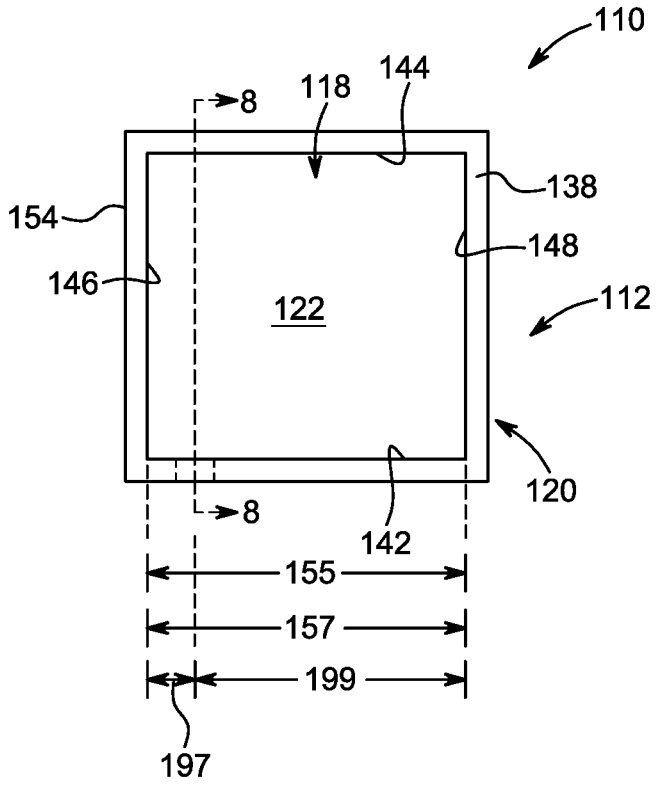
FIG. 7 is a top view of the fluid container illustrated in FIG. 5.
Figure 8:
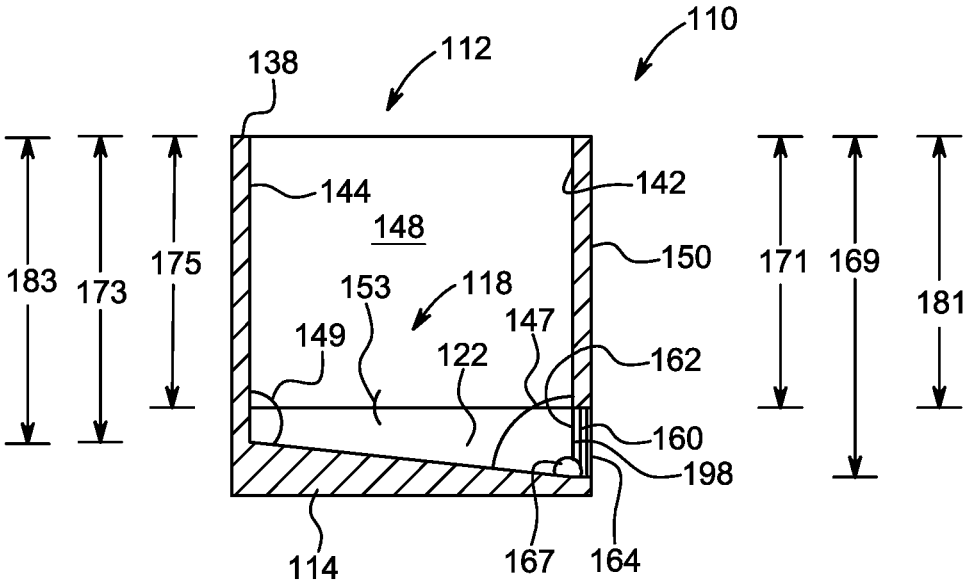
FIG. 8 is a sectional view of the fluid container illustrated in FIG. 7 taken along line 8-8.

The following detailed description and the appended drawings describe and illustrate various example embodiments of fluid containers, fluid container systems, methods of using a fluid container, and kits that include a fluid container. The description and illustration of these examples are provided to enable one skilled in the art to make and use a fluid container, a fluid container system, to practice a method of using a fluid container, and to make a kit that includes a fluid container. They are not intended to limit the scope of the claims in any manner.

FIGS. 1, 2, 3, and 4 illustrate a first example fluid container 10. The fluid container 10 has a main body 12, a first support leg 14, and a second support leg 16.

In the illustrated embodiment, the main body 12 has a bottom wall 18 and a sidewall 20. The bottom wall 18 has a bottom wall thickness 21, a bottom wall first internal surface 22, a bottom wall second internal surface 24, a bottom wall third internal surface 26, a bottom wall first external surface 28, a bottom wall second internal surface 30, and a bottom wall third external surface 32. The bottom wall thickness 21 is substantially constant (e.g., the thickness varies between about 0% and about 5%). The bottom wall first internal surface 22 is disposed between the bottom wall second internal surface 24 and the bottom wall third internal surface 26. The bottom wall first external surface 28 is disposed between the bottom wall second external surface 30 and the bottom wall third external surface 32. In the illustrated embodiment, the bottom wall first internal surface 22 is parallel to the bottom wall first external surface 28, the bottom wall second internal surface 24 is parallel to the bottom wall second external surface 30, and the bottom wall third internal surface 26 is parallel to the bottom wall third external surface 32. Each of the bottom wall first internal surface 22, the bottom wall second internal surface 24, and the bottom wall third internal surface 26 is continuous and uninterrupted. The bottom wall first internal surface 22 is disposed at a first angle 23 relative to the bottom wall second internal surface 24 and is disposed at a second angle 25 relative to the bottom wall third internal surface 26. Each of the first angle 23 and the second angle 25 is greater than 90 degrees, less than 180 degrees, and, in the illustrated embodiment, are equal to one another.

In the illustrated embodiment, the sidewall 20 has a sidewall thickness 37, a sidewall top end 38, a sidewall bottom end 40 disposed adjacent to the bottom wall 18, a sidewall first internal surface 42, a sidewall second internal surface 44, a sidewall third internal surface 46, a sidewall fourth internal surface 48, a sidewall first external surface 50, a sidewall second external surface 52, a sidewall third external surface 54, and a sidewall fourth external surface 56. The sidewall thickness 37 is substantially constant (e.g., the thickness varies between about 0% and about 5%). The sidewall first internal surface 42 is disposed substantially opposite from the sidewall second internal surface 44 (e.g., an axis that is disposed perpendicular to a portion of the sidewall first internal surface 42 extends through the sidewall first internal surface 42 and the sidewall second internal surface 44) and is disposed adjacent the sidewall third internal surface 46 and the sidewall fourth internal surface 48. The sidewall third internal surface 46 is disposed substantially opposite from the sidewall fourth internal surface 48 (e.g., an axis that is disposed perpendicular to a portion of the sidewall third internal surface 46 extends through the sidewall third internal surface 46 and the sidewall fourth internal surface 48) and is disposed adjacent the sidewall first internal surface 42 and the sidewall second internal surface 44.

In the illustrated embodiment, the sidewall first internal surface 42 is parallel to the sidewall first external surface 50, the sidewall second internal surface 44 is parallel to the sidewall second external surface 52, the sidewall third internal surface 46 is parallel to the sidewall third external surface 54, and the sidewall fourth internal surface 48 is parallel to the sidewall fourth external surface 56. Each of the sidewall first internal surface 42, the sidewall second internal surface 44, the sidewall third internal surface 46, and the sidewall fourth internal surface 48 is continuous and uninterrupted. The sidewall first internal surface 42 is disposed at a first angle 39 relative to the sidewall third internal surface 46 and is disposed at a second angle 41 relative to the sidewall fourth internal surface 48. The sidewall second internal surface 44 is disposed at a third angle 43 relative to the sidewall third internal surface 46 and at a fourth angle 45 relative to the sidewall fourth internal surface 48. In the illustrated embodiment, each of the first angle 39, the second angle 41, the third angle 43, and the fourth angle 45 is substantially equal to 90 degrees (e.g., varies between about 0% and about 5%).

While the bottom wall 18 and sidewall 20 have been illustrated as having particular structural arrangements, a bottom wall and sidewall included in a fluid container can have any suitable structural arrangement and selection of a suitable structural arrangement can be based on various considerations, such as the type and/or amount of fluid intended to be disposed in a fluid container. For example, a bottom wall and/or sidewall included in a fluid container can have any suitable number of internal surfaces and/or external surfaces and an external surface included in the fluid container can be disposed at any suitable angle relative to an internal surface. Examples of numbers of internal surfaces and/or external surfaces considered suitable to include on a bottom wall and/or sidewall of a fluid container include one, at least one, two, a plurality, three, four, five, six, seven, eight, nine, and any other number considered suitable for a particular embodiment. Examples of angles or configurations considered suitable to position an external surface relative to an internal surface include angles or configurations in which the internal surface is disposed parallel to, at an obtuse angle, or at an acute angle relative to the external surface, and any other angle or configuration considered suitable for a particular embodiment. Alternatively, a plurality of internal surfaces can define a first configuration (e.g., fluid holding cavity as described herein) and a plurality of external surface can define a second configuration that is different than the first configuration. For example, a plurality of internal surfaces can define a cuboidal cavity that has a single, or multifaceted, bottom surface and the plurality of external surfaces, or a single exterior surface, can define a cylindrical shape. Examples of types of surfaces considered suitable for a bottom wall internal surface, a bottom wall external surface, a sidewall internal surface, and/or a sidewall external surface include continuous surfaces, uninterrupted surfaces, continuous and uninterrupted surfaces, curved surfaces, surfaces that define one or more projections and/or recesses, and/or any other surface considered suitable for a particular embodiment.

While the bottom wall internal surfaces 22, 24, 26 have been illustrated as disposed at particular angles relative to one another, the bottom wall external surfaces 28, 30, 32 have been illustrated as disposed at particular angles to one another, the sidewall internal surfaces 42, 44, 46, 48 have been illustrated as disposed at particular angles relative to one another, and the sidewall external surfaces 50, 52, 54, 56 have been illustrated as disposed at particular angles relative to one another, an internal surface included in a fluid container can be disposed at any suitable angle relative to another internal surface and/or an external surface included in a fluid container can be disposed at any suitable angle relative to another external surface. Selection of a suitable angle to dispose an internal surface relative to another internal surface and/or an external surface relative to another external surface can be based on various considerations, including the type and amount of fluid intended to be disposed in a fluid container. Examples of angles considered suitable to position an internal surface relative to another internal surface and/or an external surface relative to another external surface include angles that are substantially equal to 90 degrees, greater than 90 degrees, less than 90 degrees, substantially equal to 180 degrees, greater than 180 degrees, less than 180 degrees, between about 91 degrees and about 179 degrees, obtuse, acute, and any other angle considered suitable for a particular embodiment. Examples of suitable transitions between a first surface and a second surface include hard edges, curved edges, faceted transitions, and any other transition considered suitable for a particular embodiment.

In the illustrated embodiment, the sidewall first internal surface 42 is disposed at an angle 47 relative to the bottom wall first internal surface 22, the sidewall second internal surface 44 is dispose at an angle 49 relative to the bottom wall first internal surface 22, the sidewall third internal surface 46 is disposed at an angle 51 relative to the bottom wall second internal surface 24, and the sidewall fourth internal surface 48 is disposed at an angle 53 relative to the bottom wall third internal surface 26. The angle 47 is less than 90 degrees, the angle 49 is greater than 90 degrees, the angle 51 is greater than 90 degrees, and the angle 53 is greater than 90 degrees. In the illustrated embodiment, the angle 51 and the angle 53 are equal to one another.

While the sidewall internal surfaces 42, 44, 46, 48 have been illustrated as disposed at particular angles relative to the bottom wall internal surfaces, a sidewall internal surface included in a fluid container can be disposed at any suitable angle relative to a bottom wall internal surface. Selection of a suitable angle to dispose a sidewall internal surface relative to a bottom wall internal surface can be based on various considerations, including the type and amount of fluid intended to be disposed in a fluid container. Examples of angles considered suitable to position a sidewall internal surface relative to a bottom wall internal surface include angles that are substantially equal to 90 degrees, greater than 90 degrees, less than 90 degrees, substantially equal to 180 degrees, greater than 180 degrees, less than 180 degrees, between about 91 degrees and about 179 degrees, obtuse, acute, and any other angle considered suitable for a particular embodiment.

The bottom wall first internal surface 22 extends from the sidewall second internal surface 44 to the sidewall first internal surface 42 and has a first width 55 disposed adjacent to the sidewall first internal surface 42 and a second width 57 disposed adjacent to the sidewall second internal surface 44. The second width 57 is greater than the first width 55. The bottom wall second internal surface 24 extends from the sidewall first internal surface 42 to the sidewall second internal surface 44 and has a first width 59 disposed adjacent to the sidewall first internal surface 42 and a second width 61 disposed adjacent to the sidewall second internal surface 44. The first width 59 is greater than the second width 61. In the illustrated embodiment, the bottom wall second internal surface 24 extends from the sidewall first internal surface 42 to the edge between the sidewall second internal surface 44 and the sidewall third internal surface 46. The bottom wall third internal surface 26 extends from the sidewall first internal surface 42 to the sidewall second internal surface 44 and has a first width 63 disposed adjacent to the sidewall first internal surface 42 and a second width 65 disposed adjacent to the sidewall second internal surface 44. The first width 63 is greater than the second width 65. In the illustrated embodiment, the bottom wall third internal surface 26 extends from the sidewall first internal surface 42 to the edge between the sidewall second internal surface 44 and the sidewall fourth internal surface 48. While each of the bottom wall internal surfaces 22, 24, and 26 has been described as having a particular widths at particular locations, a bottom wall internal surface can have any suitable width at any location and selection of a suitable width for a bottom wall internal surface can be based on various considerations, including the structural arrangement of a sidewall of a fluid container. Various alternative widths for a bottom wall internal surface are illustrated and described herein.

In the illustrated embodiment, the sidewall 20 defines a passageway 60 that extends from a first opening 62 defined on the sidewall first internal surface 42 to a second opening 64 defined on the sidewall first external surface 50. The passageway 60 has a constant and uninterrupted inside diameter and is centrally located between the sidewall third internal surface 46 and the sidewall fourth internal surface 48 on the sidewall first internal surface 42 and is centrally located between the sidewall third external surface 54 and the sidewall fourth external surface 56 on the sidewall first external surface 50. This positions the passageway 60 on a plane that extends through the bottom wall first internal surface 22, the sidewall first internal surface 42, and the sidewall second internal surface 44. The passageway 60 is sized and configured to receive another component, device, element, or feature (e.g., plug, valve, drain, liner), as described in more detail herein. While the passageway 60 has been illustrated as having a constant and uninterrupted diameter that extends from the first opening 62 to the second opening 64, a passageway defined by a sidewall can have any suitable configuration and selection of a suitable configuration for a passageway defined by a sidewall can be based on various considerations, such as the intended use of the fluid container on which the passageway is defined. For example, a passageway defined by a sidewall can include an internal thread that extends along a portion, or the entirety of, the length of the passageway (e.g., from the first opening to the second opening) and that is sized and configured to mate with and interact with another component, device, element, or feature. Alternatively, a fluid container can omit the inclusion of a passageway and a user of the fluid container can form a passageway at a desired location on the fluid container using a tool, such as a drill.

While the passageway 60 has been described as being disposed on a portion of the side wall 20 such that the first opening 62 is defined on the sidewall first internal surface 42 and the second opening 64 is defined on the sidewall first external surface 50, a passageway defined on a fluid container can be defined by any suitable wall (e.g., bottom wall, sidewall, cooperatively defined by the bottom wall and the sidewall) and the openings providing access to the passageway can be defined on any suitable surface of a fluid container and positioned at any suitable location. Selection of a suitable location to position a passageway can be based on various considerations, such as the structural arrangement of a bottom wall and/or sidewall of a fluid container. Examples of surfaces considered suitable to define a passageway first opening include on a sidewall internal surface, a bottom wall internal surface, combinations of those surfaces described, such that a portion of the wall that defines the passageway is coplanar with, not coplanar with, or disposed at an angle relative to a surface of the fluid container, and any other surface considered suitable for a particular embodiment. Examples of locations considered suitable to define an opening providing access to a passageway include locations that dispose the opening on a surface such that it is disposed equally from adjacent ends of the surface, such that it is closer to a first surface relative to its distance to a second surface, and any other location considered suitable for a particular embodiment.

The bottom wall first internal surface 22 extends from the sidewall second internal surface 44, toward the passageway 60 and the sidewall first internal surface 42, and to the passageway 60 such that the bottom wall first internal surface 22 is disposed at an angle 67 relative to a portion of the sidewall 20 that defines the passageway 60. In the illustrated embodiment, the angle 67 is 180 degrees such that the portion of the sidewall 20 that defines the passageway 60 is coplanar with the bottom wall first internal surface 22. The bottom wall first internal surface 22 extends from the sidewall second internal surface 44 to the sidewall first internal surface 42 at a downward slope, the bottom wall second internal surface 24 extends from the sidewall third internal surface 46 to the bottom wall first internal surface 22 at a downward slope, and the bottom wall third internal surface 26 extends from the sidewall fourth internal surface 48 to the bottom wall first internal surface 22 at a downward slope. This configuration results in a sidewall first internal surface 42 that has a sidewall first internal surface first length 69, a sidewall first internal surface second length (not shown), and a sidewall first internal surface third length 73, a sidewall second internal surface 44 that has a sidewall second internal surface first length 75, a sidewall third internal surface 46 that has a sidewall third internal surface first length (not shown), and a sidewall fourth internal surface 48 that has a sidewall fourth internal surface first length 79. The sidewall first internal surface first length 69 extends from the sidewall top end 38 to the bottom wall first internal surface 22. The sidewall first internal surface second length (not shown) extends from the sidewall top end 38 to the bottom wall second internal surface 24. The sidewall first internal surface third length 73 extends from the sidewall top end 38 to the bottom wall third internal surface 26. The sidewall second internal surface first length 75 extends from the sidewall top end 38 to the bottom wall first internal surface 22. The sidewall third internal surface first length (not shown) extends from the sidewall top end 38 to the bottom wall second internal surface 24. The sidewall fourth internal surface first length 79 extends from the sidewall top end 38 to the bottom wall third internal surface 26. In the illustrated embodiment, the sidewall first internal surface first length 69 is greater than the sidewall first internal surface second length (not shown), the sidewall first internal surface third length 73, the sidewall second internal surface first length 75, the sidewall third internal surface first length (not shown), and the sidewall fourth internal surface first length 79. Each of the sidewall second internal surface first length 75, the sidewall third internal surface first length (not shown), and the sidewall fourth internal surface first length 79 are equal to one another.

The structural arrangement between the bottom wall 18 and the sidewall 20 is considered advantageous because it provides a mechanism for changing valves, actuators, or other devices attached to the fluid container and for draining any fluid disposed within the fluid container 10 without requiring manual manipulation of the fluid container 10 (e.g., lifting, tilting). For example, when the fluid container 10 is positioned on a flat and/or level surface, gravitational forces will force any fluid disposed within fluid container toward passageway 60 and out of fluid container 10. The inventor has determined that fluid containers that include structural arrangements, such as those described herein, can achieve drain equal to 90-100% drain, equal to about 90-100% drain, equal to 100% drain, or equal to about 100% drain. This is considered advantageous at least because it allows for all, or most, of the fluid in a fluid holding cavity to be removed when the passageway is unobstructed, which reduces the formation of pockets of fluid in the fluid holding cavity, the degree of cleaning required, and the number of components that need to be removed to clean a fluid container relative to fluid containers that have a passageway (e.g., drain) disposed on a bottom wall of the fluid container or that do not include the structural arrangements described herein. In addition, fluid containers that include structural arrangements, such as those described herein, provide a mechanism for accessing a passageway (e.g., passageway 60, drain) of a fluid container from a sidewall of the fluid container, which allows for a support leg to have a smaller height relative to fluid containers that have a passageway (e.g., drain) disposed on a bottom wall of the fluid container.

In the illustrated embodiment, the bottom wall 18 has a bottom wall length 81 and a bottom wall width 83. The bottom wall length 81 extends along a hypothetical plane that extends from the sidewall second internal surface 44 to the sidewall first internal surface 42. The bottom wall width 83 extends along a hypothetical plane from the sidewall third internal surface 46 to the sidewall fourth internal surface 48. The bottom wall length 81 is less than the sidewall first internal surface first length 69 and the sidewall second internal surface first length 75. The bottom wall width 83 is equal to the bottom wall length 81. The sidewall first external surface 50 is disposed from the sidewall second external surface 52 a first distance 85 measured along the sidewall top end 38 and the sidewall third external surface 54 is disposed from the sidewall fourth external surface 56 a second distance 87 measured along the sidewall top end 38. In the illustrated embodiment, the first distance 85 is equal to the second distance 87.

While the bottom wall width 83 has been illustrated as equal to the bottom wall length 81 and the first distance 85 has been illustrated as equal to the second distance 87, as described herein, a fluid container can have any suitable structural arrangement. For example, alternative embodiments can include a bottom wall that has a bottom wall width that is greater than, or less than, a bottom wall length and/or a first distance that is greater than, or less than, a second distance. Alternative embodiments can include a fluid container that has a sidewall first external surface that is disposed from a sidewall second external surface a first distance measured along a sidewall top end, a sidewall first external surface that is disposed from a sidewall second external surface a second distance measured along a sidewall bottom end, a sidewall third external surface that is disposed from a sidewall fourth external surface a third distance measured along the sidewall top end, and a sidewall third external surface that is disposed from a sidewall fourth external surface a fourth distance measured along the sidewall bottom end. In these alternative embodiments, the first distance is greater than the second distance and the third distance is greater than the fourth distance such that the fluid container main body tapers from the sidewall top end to the sidewall bottom end, which increases the stackability of the fluid containers.

In the illustrated embodiment, the bottom wall 18 (e.g., the bottom wall first internal surface 22, the bottom wall second internal surface 24, and the bottom wall third internal surface 26) and the side wall 18 (e.g., the sidewall first internal surface 42, the sidewall second internal surface 44, the sidewall third internal surface 46, and the sidewall fourth internal surface 48) cooperatively define a fluid holding cavity 66 that has a fluid holding cavity top opening 68 and a fluid holding cavity bottom 70. The fluid holding cavity 66 is in fluid communication with the passageway 60 and sized and configured to receive a fluid (e.g., water) or material (e.g., plant, liner). In the illustrated embodiment, the fluid holding cavity 66 is substantially cuboidal with a faceted fluid holding cavity bottom 70.

While the fluid holding cavity 66 has been illustrated as being substantially cuboidal with a faceted fluid holding cavity bottom 70, a fluid holding cavity can have any suitable structural arrangement and any suitable capacity and selection of a suitable structural arrangement for a fluid holding cavity can be based on various considerations, such as the fluid intended on being disposed with the fluid holding cavity. Examples of structural arrangements considered suitable for a fluid holding cavity include structural arrangements that are cuboidal, cuboidal with a faceted bottom, cuboidal with a planar bottom, cylindrical, cylindrical with a faceted bottom, cylindrical with a planer bottom, spherical, spherical with a faceted bottom, spherical with a planer bottom, conical, conical with a faceted bottom, conical with a planer bottom, prismatic, prismatic with a faceted bottom, prismatic with a planer bottom, a closed top end, an open top end, and any other structural arrangement considered suitable for a particular embodiment. Examples of capacities considered suitable for a fluid holding cavity include less than one gallon, one gallon, more than one gallon, two gallons, three gallons, four gallons, five gallons, more than five gallons, ten gallons, more than ten gallons, twenty gallons, more than twenty gallons, fifty gallons, more than fifty gallons, one hundred gallons, more than one hundred gallons, and any other capacity considered suitable for a particular embodiment. For example, the fluid containers, and the fluid container systems, described herein, can be used to form any suitable container including a bucket, such as a five gallon bucket or a mop bucket, a can, such as paint can or trash can, a drink container, such as a milk container, a bottle, such as a shampoo bottle, conditioner bottle, or soap bottle, an oil container, a gas container, a cooler, and any other suitable container considered suitable for a particular embodiment.

The first support leg 14 is an elongate member and has a first support leg first end 72, a first support leg first height 74, a first support leg second end 76, a first support leg second height 78, a first support leg bottom surface 80, a first support leg length 82 that extends from the first support leg first end 72 to the first support leg second end 74, a first support leg external surface 84, and a first support leg internal surface 86. The first support leg 14 extends from the main body 12 to the first support leg bottom surface 80 and is sized and configured to support the fluid container 10, for example, on a surface (e.g., table, floor) or structure (e.g., another fluid container, rack). In the illustrated embodiment, the first support leg first height 74 is less than the first support leg second height 78 such that height of the first support leg 14 tapers from the first support leg second end 76 to the first support leg first end 72. The first support leg 14 extends from the main body 12 such that the first support leg external surface 84 is coplanar with the sidewall third external surface 54.

The second support leg 16 is an elongate member and has a second support leg first end 88, a second support leg first height 89, a second support leg second end 90, a second support leg second height 91, a second support leg bottom surface 92, a second support leg length 93 that extends from the second support leg first end 88 to the second support leg second end 90, a second support leg external surface 94, and a support leg internal surface second 96. The second support leg 16 extends from the main body 12 to the second support leg bottom surface 92 and is sized and configured to support the fluid container 10, for example, on a surface (e.g., table, floor) or structure (e.g., another fluid container, rack). In the illustrated embodiment, the second support leg first height 89 is less than the second support leg second height 91 such that height of the second support leg 16 tapers from the second support leg second end 90 to the second support leg first end 88. The second support leg 16 extends from the main body 12 such that the second support leg external surface 94 is coplanar with the sidewall fourth external surface 56. In the illustrated embodiment, the first support leg first height 74 is equal to the second support leg first height 89 and the first support leg second height 78 is equal to the second support leg second height 91. Each of the first support leg 14 and the second support leg 16 advantageously provides clearance for the storage of one or more components, devices, features, or elements under the bottom wall 18 and clearance if it is desired to stack a first fluid container on top of another fluid container, as described in more detail below.

While the fluid container 10 has been described as including a first support leg 14 and a second support leg 16 disposed at particular locations on the main body 12 and having a particular structural arrangement, a fluid container can include any suitable number of support legs, disposed at any suitable location on a main body, and having any suitable structural arrangement. Selection of a suitable number of supports legs, a suitable location to position a support leg, and a suitable structural arrangement for a support leg can be based on various considerations, such as the structural arrangement of a main body of a fluid container. Examples of numbers of support legs considered suitable to include on a fluid container include one, at least one, two, a plurality, three, four, five, six, and any other number considered suitable for a particular embodiment. Examples of locations considered suitable to position a support leg on a fluid container include positioning a support leg such that an external surface of the support leg is coplanar with, or not coplanar with, a sidewall first external surface, a sidewall second external surface, a sidewall third external surface, and/or a sidewall fourth external surface, and any other location considered suitable for a particular embodiment. Examples of structural arrangements considered suitable for a support leg include elongate members, pillars, curved members, support legs that form a sinusoidal, or partial sinusoidal, configuration, and any other structural arrangement considered suitable for a particular embodiment.

A fluid container 10 (e.g., the main body 12, the first support leg 14, and the second support leg 16) can be formed of any suitable material and selection of a suitable material to form a fluid container according to a particular embodiment can be based on various considerations, including the fluid that is intended to be disposed within the fluid container. Examples of materials considered suitable to form a fluid container include metals such as stainless steel, titanium, metal alloys, thermoplastics, polymers, nylon, polyethylene, high-density polyethylene (HDPE), high-performance polyethylene (HPPE), polyurethane, silicone, materials that have a rectangular, elongated, or square cross-sectional configuration, combinations of the materials described herein, and any other material considered suitable for a particular embodiment. In the illustrated embodiment, the fluid container 10 is formed of a polymer. Alternative embodiments, however, can include a fluid container that has a main body that is formed of a first material and a support leg that is formed of a second material that is different than the first material.

A fluid container 10 (e.g., the main body 12, the first support leg 14, and the second support leg 16) can be formed of a material having any suitable degree of opaqueness, translucency, color, and/or thickness and selection of a suitable degree of opaqueness, translucency, color, and/or thickness to form a fluid container according to a particular embodiment can be based on various considerations, including the fluid and/or materials that is/are intended to be disposed within the fluid container. Examples of degrees of opaqueness or translucency considered suitable for a material that forms a fluid container include materials that are transparent, semi-transparent, opaque, semi-opaque, and any other degree of opaqueness or translucency considered suitable for a particular embodiment. Examples of colors considered suitable for a material that forms a fluid container include black, white, red, blue, grey, green, yellow, combinations of those described herein, and any other color considered suitable for a particular embodiment. For example, if one or more plants are disposed within a fluid holding cavity, the material forming the fluid container can be opaque and/or black to avoid light being disposed on the fluid and/or material (e.g., roots of plants) disposed within the fluid holding cavity. Examples of thicknesses considered suitable to for a bottom wall, a portion of a bottom wall, a sidewall, a portion of a sidewall, or any other portion of a fluid container, include thicknesses that are constant along the length and/or width of the wall, thicknesses that vary along the length and/or width of the wall, thicknesses that are equal to, substantially equal to, about equal to, less than, or greater than 0.006 inches, 0.007 inches, 0.008 inches, 0.009 inches, 0.01 inches, thicknesses between about 0.006 inches to about 0.01 inches, thicknesses between about 0.0001 inches and about 6 inches, thicknesses between about 0.0005 inches and about 0.3 inches, and any other thickness considered suitable for a particular embodiment.

FIGS. 5, 6, 7, and 8 illustrate another example fluid container 110. The fluid container 110 is similar to the fluid container 10 illustrated in FIGS. 1, 2, 3, and 4 and described above, except as detailed below. The fluid container 110 has a main body 112, a first support leg 114, and a second support leg 116.

In the illustrated embodiment, the bottom wall 118 has a bottom wall first internal surface 122 and a bottom wall first external surface 128, which is disposed at an acute angle relative to the bottom wall first internal surface 122. Each of the bottom wall first internal surface 122 and the bottom wall first external surface 128 is continuous and uninterrupted. The sidewall first internal surface 142 is disposed at an angle 147 relative to the bottom wall first internal surface 122, the sidewall second internal surface 144 is dispose at an angle 149 relative to the bottom wall first internal surface 122, the sidewall third internal surface 146 is disposed at an angle 157 relative to the bottom wall first internal surface 122, and the sidewall fourth internal surface 148 is disposed at an angle 153 relative to the bottom wall first internal surface 122. The angle 147 is less than 90 degrees, the angle 149 is greater than 90 degrees, the angle 157 is less than 90 degrees, and the angle 153 is greater than 90 degrees. The bottom wall first internal surface 122 extends from the sidewall second internal surface 144 to the sidewall first internal surface 142 and has a first width 155 disposed adjacent to the sidewall first internal surface 142 and a second width 157 disposed adjacent to the sidewall second internal surface 144. The second width 157 is equal to the first width 155.

In the illustrated embodiment, the sidewall 120 defines a passageway 160 that extends from a first opening 162 defined on the sidewall first internal surface 142 to a second opening 164 defined on the sidewall first external surface 150. In the illustrated embodiment, the first opening 162 is disposed a first distance 197 from the sidewall third internal surface 146 and a second distance 199 from the sidewall fourth internal surface 148 that is greater than the first distance 197. This configuration positions the passageway 160 closer to the sidewall third internal surface 146 than it is positioned relative to the sidewall fourth internal surface 148. In alternative embodiments, a surface that defines a passageway can be disposed at an angle relative to a sidewall internal surface (e.g., coplanar, sidewall third internal surface). In the illustrated embodiment, the sidewall 120 defines a thread 198 within the passageway 160 that extends from the first opening 162 to the second opening 164 and is sized and configured to mate with the thread of another component, device, element, or feature (e.g., plug, valve, drain, liner, attachment screw).

While the sidewall 120 has been illustrated as defining a thread 198 within passageway 160, the sidewall of a fluid container can define any suitable structure capable of providing attachment (e.g., releasable attachment) between a fluid container and another component, device, element, or feature. Selection of suitable structure for a sidewall to define can be based on various considerations, such as the material that forms a fluid container and/or the material that forms the component, device, element, or feature intended to be attached to the fluid container. Examples of structures considered suitable to include on a fluid container include threads, barbs, snap fit structures, and any other structure considered suitable for a particular embodiment.

The bottom wall first internal surface 122 extends from the sidewall second internal surface 144, toward the sidewall first internal surface 142, to the passageway 160 such that the bottom wall first internal surface 122 is disposed at an angle 167 relative to a portion of the sidewall 120 that defines the passageway 160. In the illustrated embodiment, the angle 167 is less than 180 degrees. The bottom wall first internal surface 122 extends from the sidewall second internal surface 144 to the sidewall first internal surface 142 at a downward slope and the bottom wall first internal surface 122 extends from the sidewall fourth internal surface 148 to the sidewall third internal surface 146 at a downward slope. This configuration results in a sidewall first internal surface 142 that has a sidewall first internal surface first length 169 and a sidewall first internal surface second length 171, a sidewall second internal surface 144 that has a sidewall second internal surface first length 173 and a sidewall second internal surface second length 175, a sidewall third internal surface 146 that has a sidewall third internal surface first length (not shown) and a sidewall third internal surface second length (not shown), and a sidewall fourth internal surface 148 that has a sidewall fourth internal surface first length 181 and a sidewall fourth internal surface second length 183. Each of the lengths 169, 171, 173, 175, 181, 183, the sidewall third internal surface first length, and the sidewall third internal surface second length extends from the sidewall top end 138 to the bottom wall first internal surface 122. In the illustrated embodiment, the sidewall first internal surface first length 169 is greater than the sidewall first internal surface second length 171, the sidewall second internal surface first length 173 is greater than the sidewall second internal surface second length 175, the sidewall third internal surface first length (not shown) is greater than the sidewall third internal surface second length (not shown), and the sidewall fourth internal surface first length 181 is less than the sidewall fourth internal surface second length 183. The structural arrangement between the bottom wall 118 and the sidewall 120 is considered advantageous because it provides a mechanism for draining any fluid disposed within the fluid container 110 without requiring manual manipulation of the fluid container 110 (e.g., lifting, tilting). For example, when the fluid container 110 is positioned on a flat and/or level surface, gravitational forces will force any fluid disposed within fluid container toward passageway 160 and out of fluid container 110.

In the illustrated embodiment, the first support leg first height 174 is less than the first support leg second height 178 and the first support leg 114 extends from the main body 112 such that the first support leg external surface 184 is coplanar with the sidewall third external surface 154. The second support leg first height 189 is less than the second support leg second height 191 and greater than the first support leg first height 174. The second support leg second height 191 is greater than the second support leg first height 189, the first support leg first height 174, and the first support leg second height 178. The second support leg 116 extends from the main body 112 such that the second support leg external surface 194 is coplanar with the sidewall fourth external surface 156.

Figure 9:
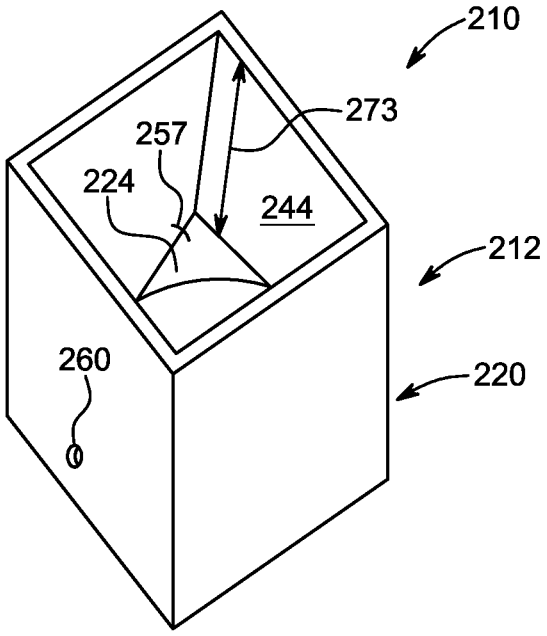
FIG. 9 is a perspective view of a third example fluid container.
Figure 10:
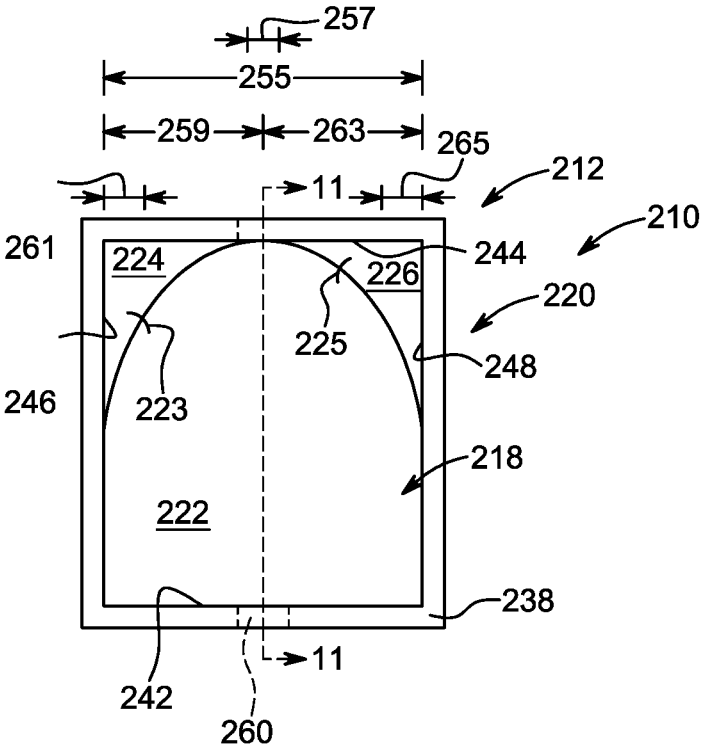
FIG. 10 is a top view of the fluid container illustrated in FIG. 9.
Figure 11:
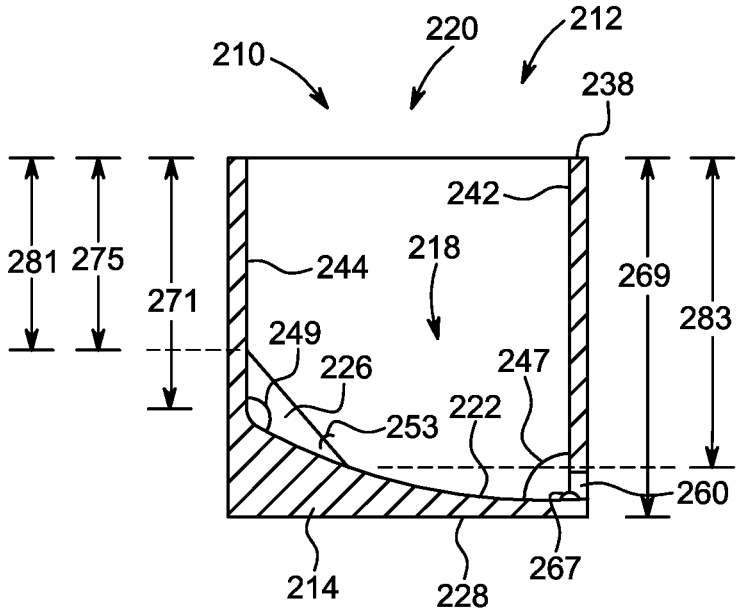
FIG. 11 is a sectional view of the fluid container illustrated in FIG. 10 taken along line 11-11.

FIGS. 9, 10, and 11 illustrate another example fluid container 210. The fluid container 210 is similar to the fluid container 10 illustrated in FIGS. 1, 2, 3, and 4 and described above, except as detailed below. The fluid container 210 has a main body 212 and a first support leg 214.

In the illustrated embodiment, the main body 212 has a bottom wall 218 and a sidewall 220. The bottom wall 218 has a bottom wall first internal surface 222, a bottom wall second internal surface 224, a bottom wall third internal surface 226, and a bottom wall first external surface 228. The bottom wall first internal surface 222 is disposed between the bottom wall second internal surface 224 and the bottom wall third internal surface 226. The bottom wall first internal surface 222 is disposed at an angle relative to the bottom wall first external surface 228 that is less than 90 degrees. The bottom wall first internal surface 222 is a curved, continuous, and uninterrupted surface that extends from the sidewall second internal surface 244 to the sidewall first internal surface 242. Each of the bottom wall second internal surface 224 and the bottom wall third internal surface 226 is continuous and uninterrupted. The bottom wall first internal surface 222 is disposed at a first angle 223 relative to the bottom wall second internal surface 224 and is disposed at a second angle 225 relative to the bottom wall third internal surface 226. Each of the first angle 223 and the second angle 225 is greater than 90 degrees, less than 180 degrees, and, in the illustrated embodiment, are equal to one another.

The sidewall first internal surface 242 is disposed at an angle 247 relative to the bottom wall first internal surface 222, the sidewall second internal surface 244 is dispose at an angle 249 relative to the bottom wall first internal surface 222, the sidewall third internal surface 246 is disposed at an angle 257 relative to the bottom wall second internal surface 224, and the sidewall fourth internal surface 248 is disposed at an angle 253 relative to the bottom wall third internal surface 226. The angle 247 is less than 90 degrees, the angle 249 is greater than 90 degrees, the angle 257 is greater than 90 degrees, and the angle 253 is greater than 90 degrees. In the illustrated embodiment, the angle 257 and the angle 253 are equal to one another.

The bottom wall first internal surface 222 extends from the sidewall second internal surface 244 to the sidewall first internal surface 242 and has a first width 255 disposed adjacent to the sidewall first internal surface 242 and a second width 257 disposed adjacent to the sidewall second internal surface 244. The second width 257 is less than the first width 255. The bottom wall second internal surface 224 extends from the sidewall second internal surface 244 toward the sidewall first internal surface 242 and has a first width 259 disposed adjacent to the sidewall second internal surface 244 and a second width 261 disposed between the sidewall second internal surface 244 and the sidewall first internal surface 242. The first width 259 is greater than the second width 261. The bottom wall third internal surface 226 extends from the sidewall second internal surface 244 toward the sidewall first internal surface 242 and has a first width 263 disposed adjacent to the sidewall second internal surface 244 and a second width 265 disposed between the sidewall second internal surface 244 and the sidewall first internal surface 242. The first width 263 is greater than the second width 265.

The bottom wall first internal surface 222 extends from the sidewall second internal surface 244, toward the sidewall first internal surface 242, to the passageway 260 such that the bottom wall first internal surface 222 is disposed at an angle 267 relative to a portion of the sidewall 220 that defines the passageway 260. In the illustrated embodiment, the angle 267 is less than 180 degrees. The bottom wall first internal surface 222 extends from the sidewall second internal surface 244 to the sidewall first internal surface 242 at a downward slope, the bottom wall second internal surface 224 extends from the sidewall third internal surface 246 to the bottom wall first internal surface 222 at a downward slope, and the bottom wall third internal surface 226 extends from the sidewall fourth internal surface 248 to the bottom wall first internal surface 222 at a downward slope. This configuration results in a sidewall first internal surface 242 that has a sidewall first internal surface first length 269, a sidewall second internal surface 244 that has a sidewall second internal surface first length 271, a sidewall second internal surface second length 273, a sidewall second internal surface third length 275, a sidewall third internal surface 246 that has a sidewall third internal surface first length (not shown), a sidewall third internal surface second length (not shown), and a sidewall fourth internal surface 248 that has a sidewall fourth internal surface first length 281 and a sidewall fourth internal surface second length 283. The sidewall first internal surface first length 269 extends from the sidewall top end 238 to the bottom wall first internal surface 222. The sidewall second internal surface first length 271 extends from the sidewall top end 238 to the bottom wall first internal surface 222. The sidewall second internal surface second length 273 extends from the sidewall top end 238 to the bottom wall second internal surface 224. The sidewall second internal surface third length 275 extends from the sidewall top end 238 to the bottom wall third internal surface 226. The sidewall third internal surface first length (not shown) extends from the sidewall top end 238 to the bottom wall second internal surface 224. The sidewall third internal surface second length (not shown) extends from the sidewall top end 238 to the bottom wall first internal surface 222. The sidewall fourth internal surface first length 281 extends from the sidewall top end 238 to the bottom wall third internal surface 226. The sidewall fourth internal surface second length 283 extends from the sidewall top end 238 to the bottom wall first internal surface 222. In the illustrated embodiment, the sidewall first internal surface first length 269 is greater than each of the lengths 271, 273, 275, 281, 283, the sidewall third internal surface first length (not shown), and the sidewall third internal surface second length (not shown). The sidewall second internal surface first length 271 is greater than each of the lengths 273, 275, 281, and the sidewall third internal surface first length (not shown). The structural arrangement between the bottom wall 218 and the sidewall 220 is considered advantageous because it provides a mechanism for draining any fluid disposed within the fluid container 210 without requiring manual manipulation of the fluid container 210 (e.g., lifting, tilting). For example, when the fluid container 210 is positioned on a flat and/or level surface, gravitational forces will force any fluid disposed within fluid container toward passageway 260 and out of fluid container 210.

Figure 12:
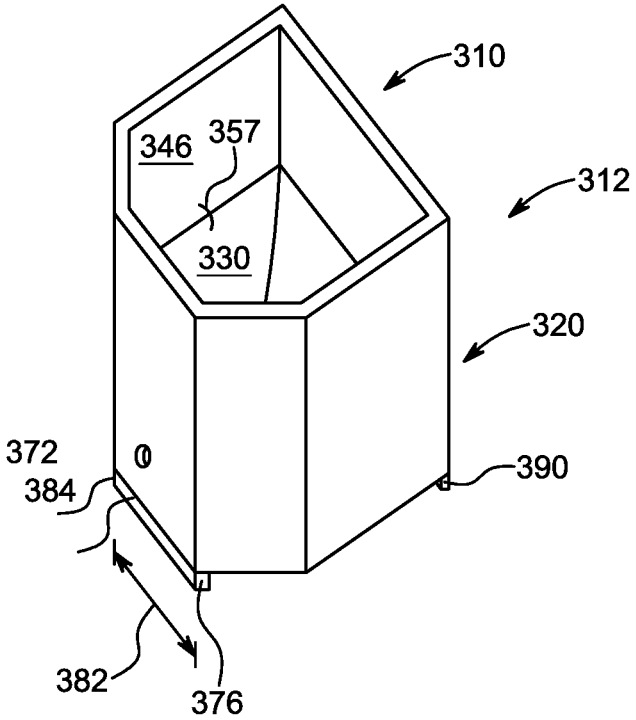
FIG. 12 is a perspective view of a fourth example fluid container.
Figure 13:
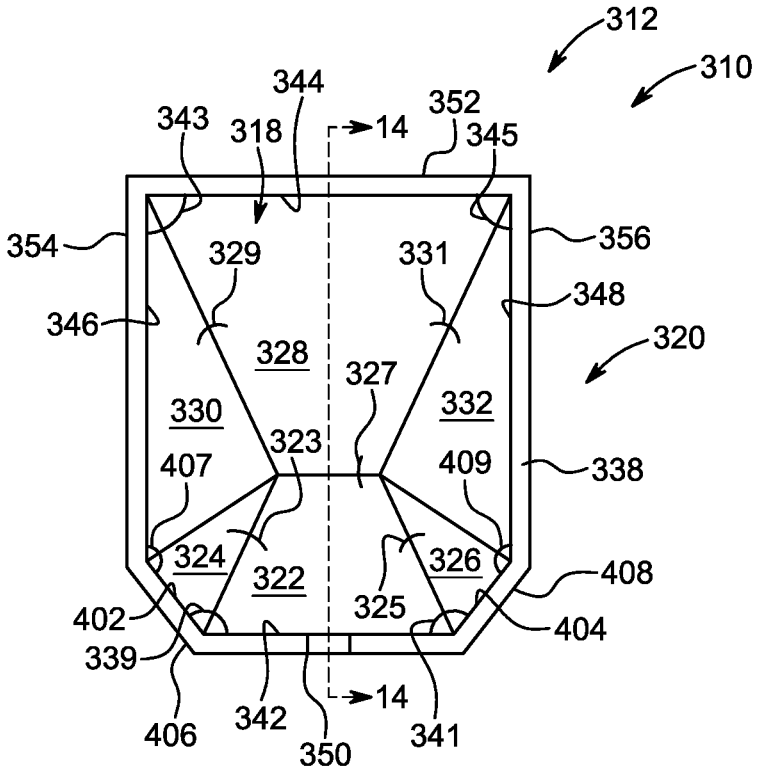
FIG. 13 is a top view of the fluid container illustrated in FIG. 12.
Figure 14:
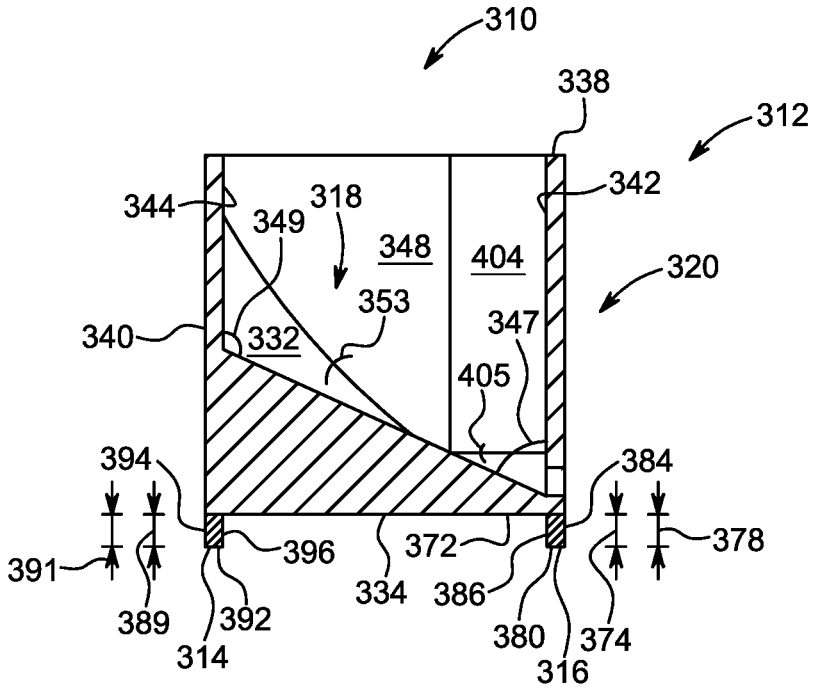
FIG. 14 is a sectional view of the fluid container illustrated in FIG. 13 taken along line 14-14.

FIGS. 12, 13, and 14 illustrate another example fluid container 310. The fluid container 310 is similar to the fluid container 10 illustrated in FIGS. 1, 2, 3, and 4 and described above, except as detailed below. The fluid container 310 has a main body 312, a first support leg 314, and a second support leg 316.

In the illustrated embodiment, the bottom wall 318 has a bottom wall first internal surface 322, a bottom wall second internal surface 324, a bottom wall third internal surface 326, a bottom wall fourth internal surface 328, a bottom wall fifth internal surface 330, a bottom wall sixth internal surface 332, and a bottom wall first external surface 334. The bottom wall first internal surface 322 is disposed between the bottom wall second internal surface 324, the bottom wall third internal surface 326, and the bottom wall fourth internal surface 328. The bottom wall fourth internal surface 328 is disposed between the bottom wall first internal surface 322, the bottom wall fifth internal surface 330, and the bottom wall sixth internal surface 332. Each of the bottom wall internal surfaces 322, 324, 326, 328, 330, 332 is continuous and uninterrupted. The bottom wall first internal surface 322 is disposed at a first angle 323 relative to the bottom wall second internal surface 324, is disposed at a second angle 325 relative to the bottom wall third internal surface 326, and is disposed at a third angle 327 relative to the bottom wall fourth internal surface 328. Each of the first angle 323, the second angle 325, and the third angle 327 is greater than 90 degrees and less than 180 degrees. The bottom wall fourth internal surface 328 is disposed at a first angle 329 relative to the bottom wall fifth internal surface 330 and is disposed at a second angle 331 relative to the bottom wall sixth internal surface 332. Each of the first angle 329 and the second angle 331 is greater than 90 degrees and less than 180 degrees.

In the illustrated embodiment, the sidewall 320 has a sidewall top end 338, a sidewall bottom end 340 disposed adjacent to the bottom wall 318, a sidewall first internal surface 342, a sidewall second internal surface 344, a sidewall third internal surface 346, a sidewall fourth internal surface 348, a sidewall fifth internal surface 402, a sidewall sixth internal surface 404, a sidewall first external surface 350, a sidewall second external surface 352, a sidewall third external surface 354, a sidewall fourth external surface 356, a sidewall fifth external surface 406, and a sidewall sixth external surface 408. The sidewall first internal surface 342 is disposed substantially opposite from the sidewall second internal surface 344 (e.g., an axis that is disposed perpendicular to a portion of the sidewall first internal surface 342 extends through the sidewall first internal surface 342 and the sidewall second internal surface 344) and is disposed adjacent the sidewall fifth internal surface 402 and the sidewall sixth internal surface 404. The sidewall second internal surface 344 is disposed adjacent the sidewall third internal surface 346 and the sidewall fourth internal surface 348. The sidewall third internal surface 346 is disposed substantially opposite from the sidewall fourth internal surface 348 (e.g., an axis that is disposed perpendicular to a portion of the sidewall third internal surface 346 extends through the sidewall third internal surface 346 and the sidewall fourth internal surface 348) and is disposed adjacent the sidewall second internal surface 344 and the sidewall fifth internal surface 402. The sidewall fourth internal surface is disposed adjacent the sidewall second internal surface 344 and the sidewall sixth internal surface 404.

Each of the sidewall internal surfaces 342, 344, 346, 348, 402, 404 is continuous and uninterrupted. The sidewall first internal surface 342 is disposed at a first angle 339 relative to the sidewall fifth internal surface 406 and is disposed at a second angle 341 relative to the sidewall sixth internal surface 408. The sidewall second internal surface 344 is disposed at a third angle 343 relative to the sidewall third internal surface 346 and at a fourth angle 345 relative to the sidewall fourth internal surface 48. The sidewall third internal surface 346 is disposed at a fifth angle 407 relative to the sidewall fifth internal surface 406 and the sidewall fourth internal surface 348 is disposed at a sixth angle 409 relative to the sidewall sixth internal surface 408. In the illustrated embodiment, each of the angles 343, 345 is substantially equal to 90 degrees. Each of the angles 339, 341, 407, 409 is greater than 90 degrees. The first angle 339 is equal to the second angle 341 and the fifth angle 407 is equal to the sixth angle 409.

The sidewall first internal surface 342 is disposed at an angle 347 relative to the bottom wall first internal surface 322, the sidewall second internal surface 344 is dispose at an angle 349 relative to the bottom wall fourth internal surface 328, the sidewall third internal surface 346 is disposed at an angle 357 relative to the bottom wall fifth internal surface 330, the sidewall fourth internal surface 348 is disposed at an angle 353 relative to the bottom wall sixth internal surface 332, the sidewall fifth internal surface 402 is disposed at an angle (not shown) relative to the bottom wall second internal surface 324, and the sidewall sixth internal surface 404 is disposed at an angle 405 relative to the bottom wall third internal surface 326. The angle 347 is less than 90 degrees, the angle 349 is greater than 90 degrees, the angle 357 is greater than 90 degrees, the angle 353 is greater than 90 degrees, the angle between the sidewall fifth internal surface 402 and the bottom wall second internal surface 324 is greater than 90 degrees, and the angle 405 is greater than 90 degrees. In the illustrated embodiment, the angles 357, 353 are equal to one another and the angle 405 is equal the angle between the sidewall fifth internal surface 402 and the bottom wall second internal surface 324.

The bottom wall first internal surface 322 extends from the bottom wall fourth internal surface 328, toward the sidewall first internal surface 342, to the passageway 360 such that the bottom wall first internal surface 322 is disposed at an angle relative to a portion of the sidewall 320 that defines the passageway 360. In the illustrated embodiment, the angle is less than 180 degrees. The bottom wall first internal surface 322 extends from the bottom wall fourth internal surface 328 to the sidewall first internal surface 342 at a downward slope, the bottom wall second internal surface 324 extends from the sidewall fifth internal surface 402 to the bottom wall first internal surface 322 at a downward slope, the bottom wall third internal surface 326 extends from the sidewall sixth internal surface 404 to the bottom wall first internal surface 322 at a downward slope, the bottom wall fourth internal surface 328 extends from the sidewall second internal surface 344 to the bottom wall first internal surface 322 at a downward slope, the bottom wall fifth internal surface 330 extends from the sidewall third internal surface 346 to the bottom wall fourth internal surface 328 at a downward slope, and the bottom wall sixth internal surface 332 extends from the sidewall fourth internal surface 348 to the bottom wall fourth internal surface 328 at a downward slope. The structural arrangement between the bottom wall 318 and the sidewall 320 is considered advantageous because it provides a mechanism for draining any fluid disposed within the fluid container 310 without requiring manual manipulation of the fluid container 310 (e.g., lifting, tilting). For example, when the fluid container 310 is positioned on a flat and/or level surface, gravitational forces will force any fluid disposed within fluid container toward passageway 360 and out of fluid container 310.

Each of the first support leg 314 and the second support leg 316 is a separate member attached to the main body 312. In the illustrated embodiment, each of the supports legs 314, 316 is fused to the main body 312. The first support leg 314 is an elongate member and has a first support leg first end 372, a first support leg first height 374, a first support leg second end 376, a first support leg second height 378, a first support leg bottom surface 380, a first support leg length 382 that extends from the first support leg first end 372 to the first support leg second end 374, a first support leg external surface 384, and a first support leg internal surface 386. In the illustrated embodiment, the first support leg first height 374 is equal to the first support leg second height 378. The first support leg 314 extends from the main body 312 to the first support leg bottom surface 380 such that the first support leg external surface 384 is coplanar with the sidewall first external surface 350.

The second support leg 316 is an elongate member and has a second support leg first end (not shown), a second support leg first height 389, a second support leg second end 390, a second support leg second height 391, a second support leg bottom surface 392, a second support leg length (not shown) that extends from the second support leg first end 388 to the second support leg second end 390, a second support leg external surface 394, and a support leg internal surface second 396. In the illustrated embodiment, the second support leg first height 389 is equal to the second support leg second height 391. The second support leg 316 extends from the main body 312 to the second support leg bottom surface 392 such that the second support leg external surface 394 is coplanar with the sidewall second external surface 352. In the illustrated embodiment, the first support leg first height 374 is equal to the second support leg first height 389, the first support leg second height 378 is equal to the second support leg second height 391, and the second support leg length is greater than the first support leg length 382.

While the first support leg 314 and the second support leg 316 have been illustrated as fused to the main body 312, a support leg can be attached to a main body using any suitable technique or method of attachment. Selection of a suitable technique or method of attachment to attach a support leg to a main body can be based on various considerations, such as the material(s) that forms the main body and/or the support leg. Examples of techniques and methods of attachment considered suitable between a support leg and a main body include welding, fusing, using adhesive, and any other technique or method considered suitable for a particular embodiment.

Figure 15:
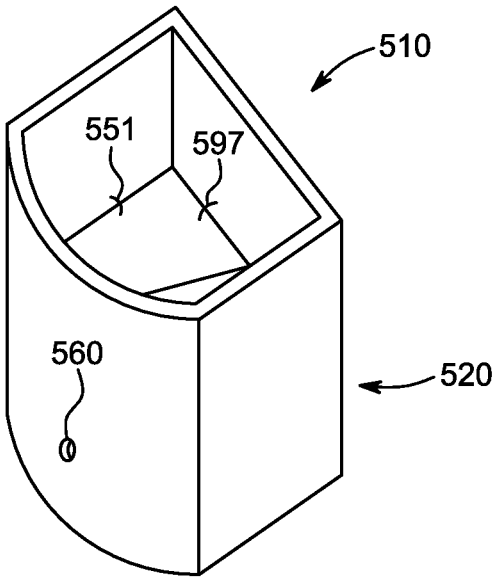
FIG. 15 is a perspective view of a fifth example fluid container.
Figure 16:
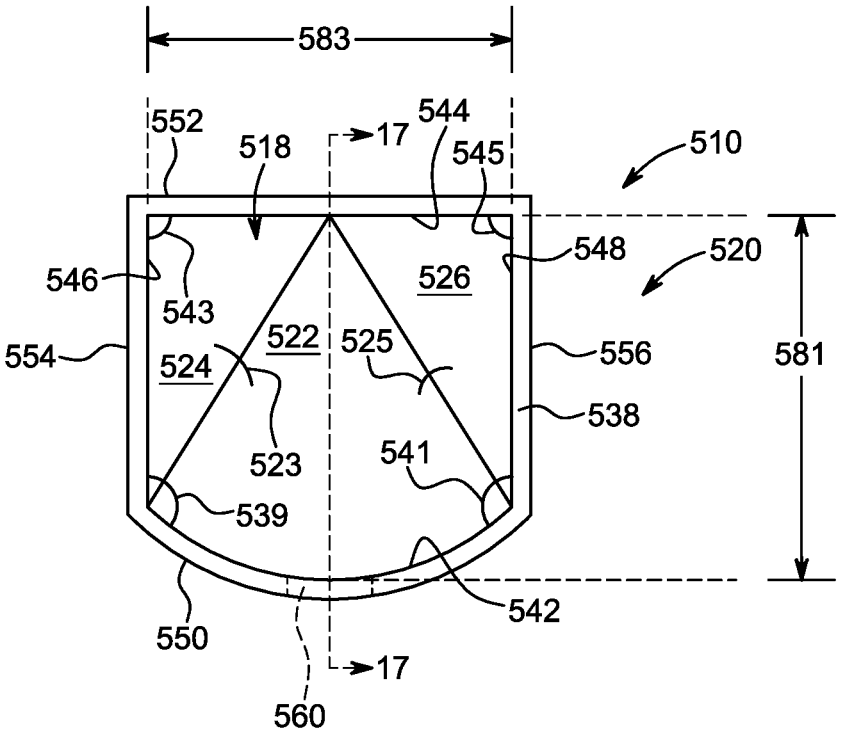
FIG. 16 is a top view of the fluid container illustrated in FIG. 15.
Figure 17:
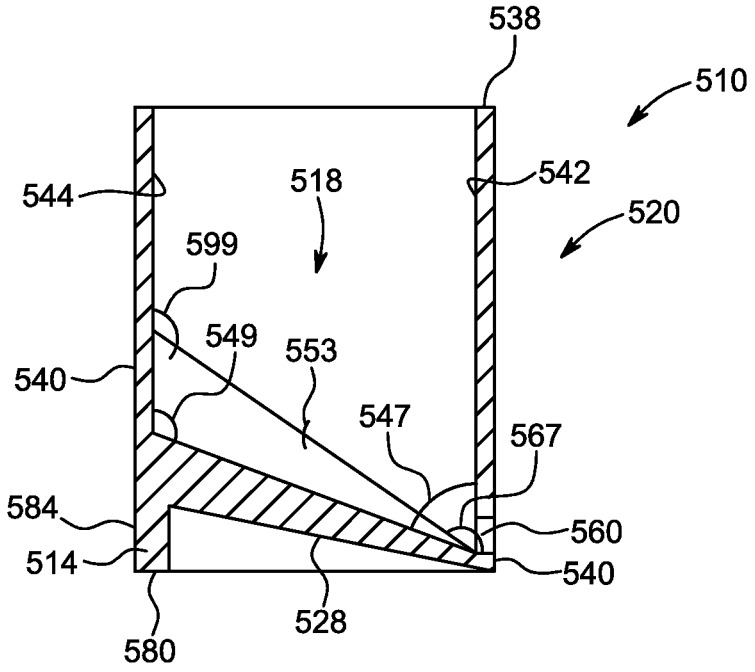
FIG. 17 is a sectional view of the fluid container illustrated in FIG. 16 taken along line 17-17.

FIGS. 15, 16, and 17 illustrate another example fluid container 510. The fluid container 510 is similar to the fluid container 10 illustrated in FIGS. 1, 2, 3, and 4 and described above, except as detailed below. The fluid container 510 has a main body 512 and a first support leg 514.

In the illustrated embodiment, the bottom wall 518 has a bottom wall first internal surface 522, a bottom wall second internal surface 524, a bottom wall third internal surface 526, and a bottom wall first external surface 528. The bottom wall first internal surface 522 is disposed between the bottom wall second internal surface 524 and the bottom wall third internal surface 526. Each of the bottom wall first internal surface 522, the bottom wall second internal surface 524, and the bottom wall third internal surface 526 is continuous and uninterrupted. The bottom wall first internal surface 522 is disposed at a first angle 523 relative to the bottom wall second internal surface 524 and is disposed at a second angle 525 relative to the bottom wall third internal surface 526. Each of the first angle 523 and the second angle 525 is greater than 90 degrees, less than 180 degrees, and, in the illustrated embodiment, are equal to one another.

In the illustrated embodiment, the sidewall 520 has a sidewall top end 538, a sidewall bottom end 540 disposed adjacent to the bottom wall 518, a sidewall first internal surface 542, a sidewall second internal surface 544, a sidewall third internal surface 546, a sidewall fourth internal surface 548, a sidewall first external surface 550, a sidewall second external surface 552, a sidewall third external surface 554, and a sidewall fourth external surface 556. Each of the sidewall first internal surface 542 and sidewall first external surface 550 is curved. Each of the sidewall second internal surface 544, the sidewall third internal surface 546, and the sidewall fourth internal surface 548 is continuous and uninterrupted. The sidewall first internal surface 542 is disposed at a first angle 539 relative to the sidewall third internal surface 546 and is disposed at a second angle 541 relative to the sidewall fourth internal surface 548. The sidewall second internal surface 544 is disposed at a third angle 543 relative to the sidewall third internal surface 546 and at a fourth angle 545 relative to the sidewall fourth internal surface 548. In the illustrated embodiment, the first angle 539 and the second angle 541 are equal to one another and greater than 90 degrees. The third angle 543 and the fourth angle 545 are equal to one another and substantially equal to 90 degrees (e.g., varies between about 0% and about 5%).

The sidewall first internal surface 542 is disposed at an angle 547 relative to the bottom wall first internal surface 522, the sidewall second internal surface 544 is disposed at an angle 549 relative to the bottom wall first internal surface 549, the sidewall second internal surface 544 is disposed at an angle 597 relative to the bottom wall second internal surface 524, the sidewall second internal surface 544 is disposed at an angle 599 relative to the bottom wall third internal surface 526, the sidewall third internal surface 546 is disposed at an angle 551 relative to the bottom wall second internal surface 524, and the sidewall fourth internal surface 548 is disposed at an angle 553 relative to the bottom wall third internal surface 526. The angle 547 is less than 90 degrees, the angle 549 is greater than 90 degrees, the angle 551 is greater than 90 degrees, the angle 553 is greater than 90 degrees, the angle 597 is greater than 90 degrees, and the angle 599 is greater than 90 degrees.

The bottom wall first internal surface 522 extends from the sidewall second internal surface 544, toward the sidewall first internal surface 542, to the passageway 560 such that the bottom wall first internal surface 522 is disposed at an angle 567 relative to a portion of the sidewall 520 that defines the passageway 560. In the illustrated embodiment, the angle 567 is greater than 90 degrees and less than 180 degrees. The bottom wall first internal surface 522 extends from the sidewall second internal surface 544 to the sidewall first internal surface 542 at a downward slope, the bottom wall second internal surface 524 extends from the sidewall third internal surface 546 to the bottom wall first internal surface 522 at a downward slope, and the bottom wall third internal surface 526 extends from the sidewall fourth internal surface 548 to the bottom wall first internal surface 522 at a downward slope. The structural arrangement between the bottom wall 518 and the sidewall 520 is considered advantageous because it provides a mechanism for draining any fluid disposed within the fluid container 510 without requiring manual manipulation of the fluid container 510 (e.g., lifting, tilting). For example, when the fluid container 510 is positioned on a flat and/or level surface, gravitational forces will force any fluid disposed within fluid container toward passageway 560 and out of fluid container 510.

In the illustrated embodiment, the bottom wall length 581 extends along a hypothetical plane that extends from the sidewall second internal surface 544 to the sidewall first internal surface 542 and the bottom wall width 583 extends along a hypothetical plane from the sidewall third internal surface 546 to the sidewall fourth internal surface 548. The bottom wall width 583 is greater than to the bottom wall length 581.

In the illustrated embodiment, the first support leg 514 extends from the main body 512 to the first support leg bottom surface 580 such that the first support leg external surface 584 is coplanar with the sidewall second external surface 552, the sidewall third external surface 554, and the sidewall fourth external surface 556. In the illustrated embodiment, the bottom wall first external surface 528 acts as a second support leg.

Figure 18:
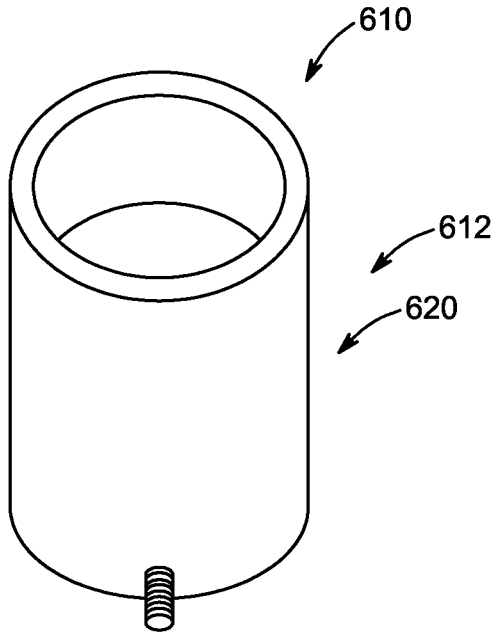
FIG. 18 is a perspective view of a sixth example fluid container.
Figure 19:
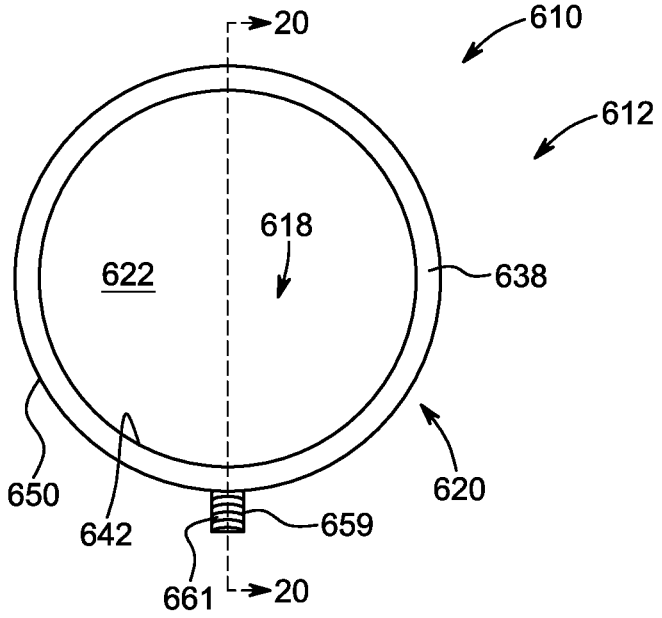
FIG. 19 is a top view of the fluid container illustrated in FIG. 18.
Figure 20:
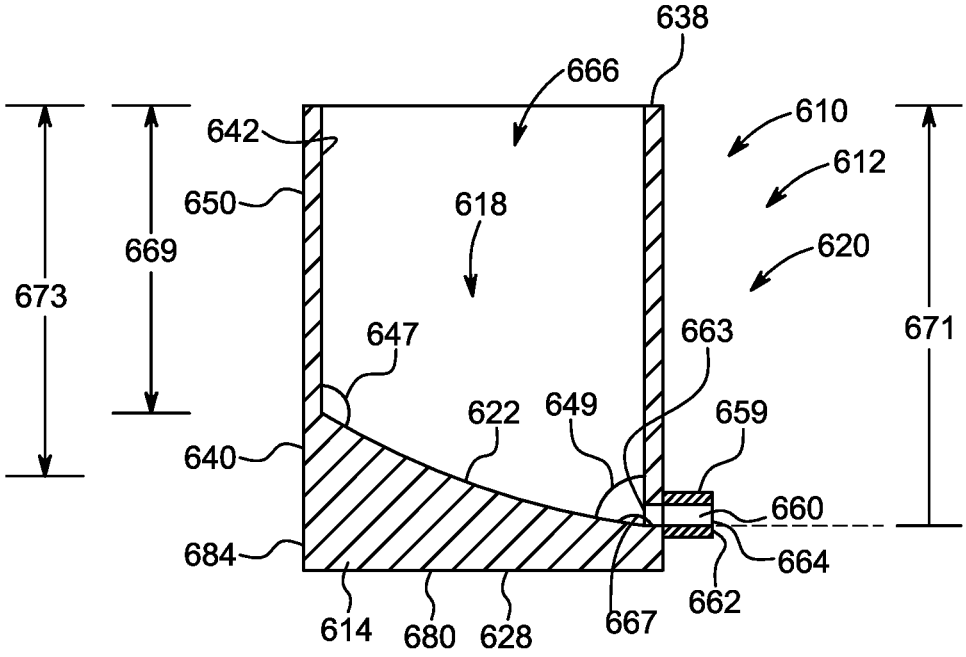
FIG. 20 is a sectional view of the fluid container illustrated in FIG. 19 taken along line 20-20.

FIGS. 18, 19, and 20 illustrate another example fluid container 610. The fluid container 610 is similar to the fluid container 10 illustrated in FIGS. 1, 2, 3, and 4 and described above, except as detailed below. The fluid container 610 has a main body 612 and a first support leg 614.

In the illustrated embodiment, the main body 612 has a bottom wall 618 and a sidewall 620. The bottom wall 618 has a bottom wall first internal surface 622 and a bottom wall first external surface 628. In the illustrated embodiment, the bottom wall first internal surface 622 is not parallel to the bottom wall first external surface 628 and is disposed at an angle relative to the bottom wall first external surface 628 that is less than 90 degrees.

In the illustrated embodiment, the sidewall 620 has a sidewall top end 638, a sidewall bottom end 640 disposed adjacent to the bottom wall 618, a sidewall first internal surface 642, and a sidewall first external surface 650. Each of the sidewall first internal surface 642 and sidewall first external surface 650 is substantially cylindrical, except for the passageway 660. The sidewall first internal surface 642 has a first radius of curvature that is less than the radius of curvature of the sidewall first external surface 650. In the illustrated embodiment, the bottom wall first internal surface 622 and the sidewall first internal surface 642 cooperatively define an open-ended cylindrical fluid holding cavity 666.

In the illustrated embodiment, the bottom wall first internal surface 622 extends from a first portion of the sidewall 620 to a second portion of the sidewall 620 at a downward slope. In the illustrated embodiment, the first portion is disposed substantially opposite the second portion across the fluid holding cavity 666 and the second portion is disposed on a plane that includes the passageway 660. The first portion is disposed at an angle 647 relative to the bottom wall first internal surface 622 and the second portion is disposed at an angle 649. The angle 647 is greater than 90 degrees and the angle 649 is less than 90 degrees.

In the illustrated embodiment, the sidewall 620 defines a projection 659 and a thread 661. The projection 659 extends from the sidewall first external surface 650 and away from the sidewall first internal surface 642 to a projection end 662. The passageway 660 extends from a first opening 663 defined on the sidewall first internal surface 642 to a second opening 664 defined on the projection end 662. The sidewall 620 defines the thread 661 on an external surface of the projection 659. The thread 661 extends from the projection end 662 toward the sidewall 620 and is sized and configured to receive another component, device, feature, or element (e.g., plug, valve, drain, liner).

While the sidewall 620 has been illustrated as defining a thread 661 on an external surface of the projection 659, the sidewall of a fluid container can define any suitable structure capable of providing attachment (e.g., releasable attachment) between a fluid container and another component, device, element, or feature. Selection of suitable structure for a sidewall to define can be based on various considerations, such as the material that forms a fluid container and/or the material that forms the component, device, element, or feature intended to be attached to the fluid container. Examples of structures considered suitable to include on a fluid container include threads, barbs, snap fit structures, and any other structure considered suitable for a particular embodiment.

The bottom wall first internal surface 622 extends from the first portion of the sidewall 620, toward the second portion of the sidewall 620, to the passageway 660 such that the bottom wall first internal surface 622 is disposed at an angle 667 relative to a portion of the sidewall 620 that defines the passageway 660. In the illustrated embodiment, the angle 667 is less than 180 degrees. The bottom wall first internal surface 622 extends from the first portion of the sidewall 620 to the second portion of the sidewall 620 at a downward slope. This configuration results in a sidewall 620 that has a sidewall first internal surface first length 669, a sidewall first internal surface second length 671, and a sidewall first internal surface third length 673. Each of the lengths 669, 671, and 673 extends from the sidewall top end 638 to the bottom wall first internal surface 622. In the illustrated embodiment, the sidewall first internal surface first length 669 is disposed at the first portion of the sidewall 620, the sidewall first internal surface second length 671 is disposed at the second portion of the sidewall 620, and the sidewall first internal surface third length 673 is disposed between the first portion of the sidewall 620 and the second portion of the sidewall 620. The sidewall first internal surface first length 669 is less than the sidewall first internal surface second length 671 and the sidewall first internal surface third length 673. The sidewall first internal surface second length 671 is greater than the sidewall first internal surface third length 673. The structural arrangement between the bottom wall 618 and the sidewall 620 is considered advantageous because it provides a mechanism for draining any fluid disposed within the fluid container 610 without requiring manual manipulation of the fluid container 610 (e.g., lifting, tilting). For example, when the fluid container 610 is positioned on a flat and/or level surface, gravitational forces will force any fluid disposed within fluid container toward passageway 660 and out of fluid container 610.

In the illustrated embodiment, the first support leg 614 is a spherical wedge and extends from the main body 612 to the first support leg bottom surface 680 such that the first support leg external surface 684 is coplanar with the sidewall first external surface 650.

Figure 21:
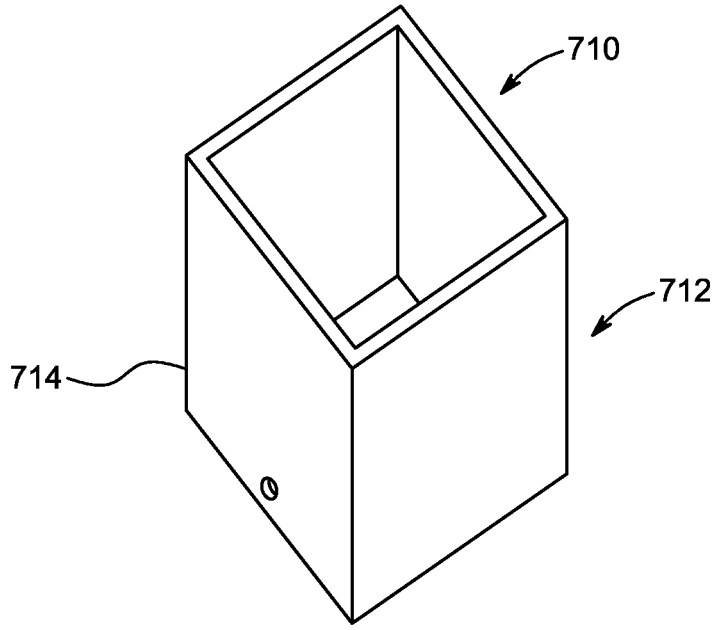
FIG. 21 is a perspective view of a seventh example fluid container.
Figure 22:
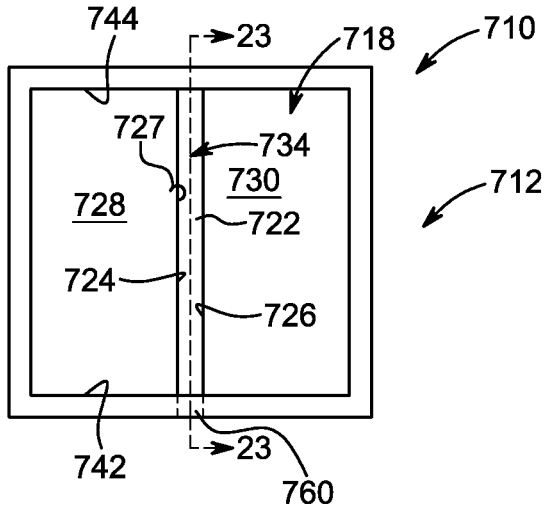
FIG. 22 is a top view of the fluid container illustrated in FIG. 21.
Figure 23:
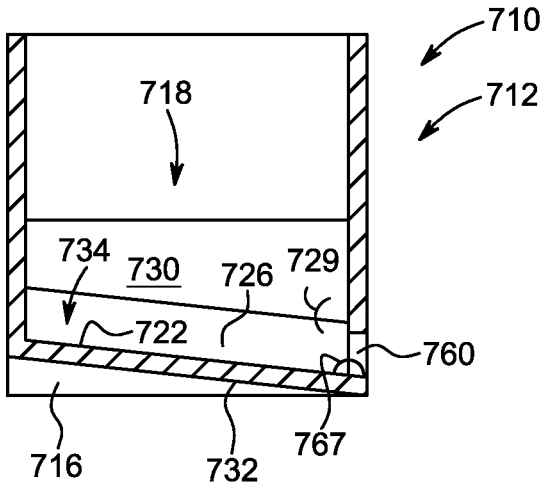
FIG. 23 is a sectional view of the fluid container illustrated in FIG. 22 taken along line 23-23.

FIGS. 21, 22, and 23 illustrate another example fluid container 710. The fluid container 710 is similar to the fluid container 10 illustrated in FIGS. 1, 2, 3, and 4 and described above, except as detailed below. The fluid container 710 has a main body 712, a first support leg 714, and a second support leg 716.

In the illustrated embodiment, the bottom wall 718 has a bottom wall first internal surface 722, a bottom wall second internal surface 724, a bottom wall third internal surface 726, a bottom wall fourth internal surface 728, a bottom wall fifth internal surface 730, and a bottom wall first external surface 732. The bottom wall first internal surface 722 is disposed between the bottom wall second internal surface 724 and the bottom wall third internal surface 726. The bottom wall second internal surface 724 is disposed between the bottom wall fourth internal surface 728 and the bottom wall first internal surface 722. The bottom wall third internal surface 726 is disposed between the bottom wall fifth internal surface 730 and the bottom wall first internal surface 722. Each of the bottom wall internal surfaces 722, 724, 726, 728, 730 is continuous and uninterrupted. The bottom wall first internal surface 722 is disposed at a first angle relative to the bottom wall second internal surface 724 and is disposed at a second angle relative to the bottom wall third internal surface 726. Each of the first angle and the second angle is equal to 90 degrees. The bottom wall second internal surface 724 is disposed at an angle 727 relative to the bottom wall fourth internal surface 728 and the bottom wall third internal surface 726 is disposed at an angle 729 relative to the bottom wall fifth internal surface 730. The angle 727 is equal to the angle 729 and each of the angles 727, 729 is greater than 90 degrees. In alternative embodiments, however, a bottom wall fourth internal surface and a bottom wall fifth internal surface can be level relative to the surface upon which a fluid container is disposed and/or a bottom wall second internal surface can be disposed at an angle equal to, or about, 90 degrees relative to a bottom wall fourth internal surface and a bottom wall third internal surface can be disposed at an angle equal to, or about, 90 degrees relative to a bottom wall fifth internal surface. In the illustrated embodiment, the bottom wall first internal surface 722, bottom wall second internal surface 724, and bottom wall third internal surface 726 cooperatively define a channel 734 that extends from a first portion of the sidewall 720 (e.g., sidewall second internal surface 744) to a second portion of the sidewall 720 (e.g., sidewall first internal surface 742) and is in fluid communication with the passageway 760. The inclusion of a channel is considered advantageous at least because it provides a mechanism to direct the flow of fluid disposed within a fluid container toward the passageway defined by the sidewall of the fluid container. A channel, such as channel 734, can be included in any suitable fluid container and/or fluid container system, such as fluid container 10, fluid container 110, fluid container 210, fluid container 310, fluid container 510, fluid container 610, fluid container 710, fluid container system 808, fluid container system 1008, fluid container system 1308, fluid container 1410 and associated structure, fluid container 1510 and associated structure, fluid container 1610 and associated structure, variations of the fluid containers or fluid container systems described herein, and any other fluid container or fluid container system considered suitable for a particular embodiment.

The bottom wall first internal surface 722 extends from the sidewall second internal surface 744, toward the sidewall first internal surface 742, to the passageway 760 such that the bottom wall first internal surface 722 is disposed at an angle 767 relative to a portion of the sidewall 720 that defines the passageway 760. In the illustrated embodiment, the angle 767 is less than 180 degrees. The bottom wall first internal surface 722 extends from the sidewall second internal surface 744 to the sidewall first internal surface 742 at a downward slope, the bottom wall second internal surface 724 extends from the bottom wall fourth internal surface 728 to the bottom wall first internal surface 722 at a downward slope (e.g., vertical), the bottom wall third internal surface 726 extends from the bottom wall fifth internal surface 730 to the bottom wall first internal surface 722 at a downward slope (e.g., vertical), the bottom wall fourth internal surface 728 extends from the sidewall third internal surface 746 to the bottom wall second internal surface 724 at a downward slope, and the bottom wall fifth internal surface 730 extends from the sidewall fourth internal surface 748 to the bottom wall third internal surface 726 at a downward slope. The structural arrangement between the bottom wall 718 and the sidewall 720 is considered advantageous because it provides a mechanism for draining any fluid disposed within the fluid container 710 without requiring manual manipulation of the fluid container 710 (e.g., lifting, tilting). For example, when the fluid container 710 is positioned on a flat and/or level surface, gravitational forces will force any fluid disposed within fluid container toward passageway 760 and out of fluid container 710. In the illustrated embodiment, the fluid holding cavity 766 is substantially cuboidal with a faceted closed bottom end 770.

FIGS. 24, 25, 26, 27, 28, and 29 illustrate an example fluid container system 808. The fluid container system 808 has a fluid container 810, a valve 904, and a lid 906. The fluid container 810 is similar to the fluid container 10 illustrated in FIGS. 1, 2, 3, and 4 and described above, except as detailed below.

While fluid container 1010 has been described as similar to fluid container 10, a fluid container system can include any suitable fluid container and selection of a suitable fluid container to include in a fluid container system can be based on various considerations, such as the intended use of the fluid container system. Examples of fluid containers considered suitable to include in a fluid container system include fluid container 10, fluid container 110, fluid container 210, fluid container 310, fluid container 510, fluid container 610, fluid container 710, fluid container 810, fluid container 1410 and associated structure, fluid container 1510 and associated structure, fluid container 1610 and associated structure, variations of the fluid containers described herein, and any other fluid container considered suitable for a particular embodiment.

Figure 25:
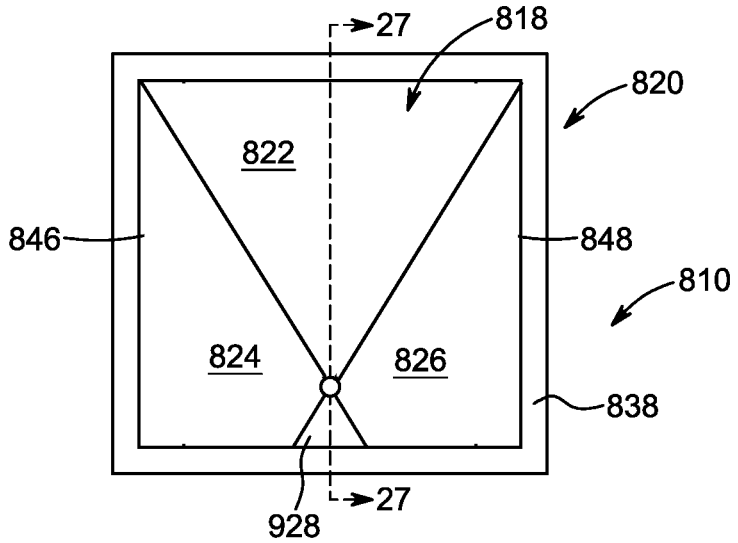
FIG. 25 is a top view of the fluid container of the fluid container system illustrated in FIG. 24.
Figure 26:
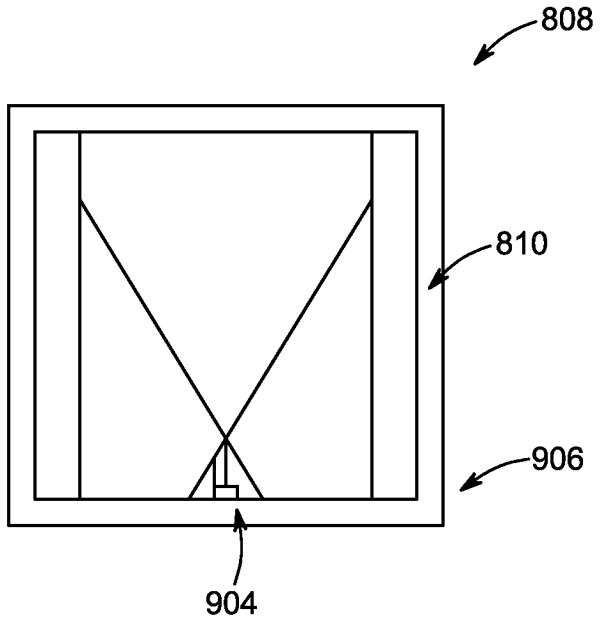
FIG. 26 is a bottom view of the fluid container system illustrated in FIG. 24.
Figure 27:
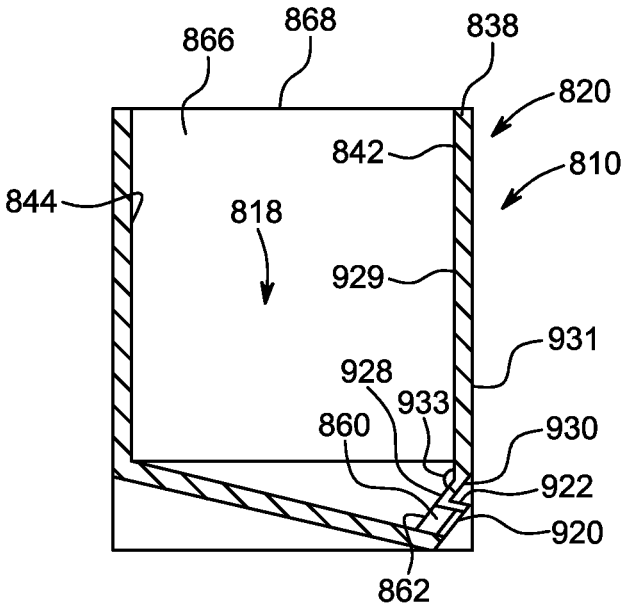
FIG. 27 is a sectional view of the fluid container illustrated in FIG. 25 taken along line 27-27.
Figure 28:
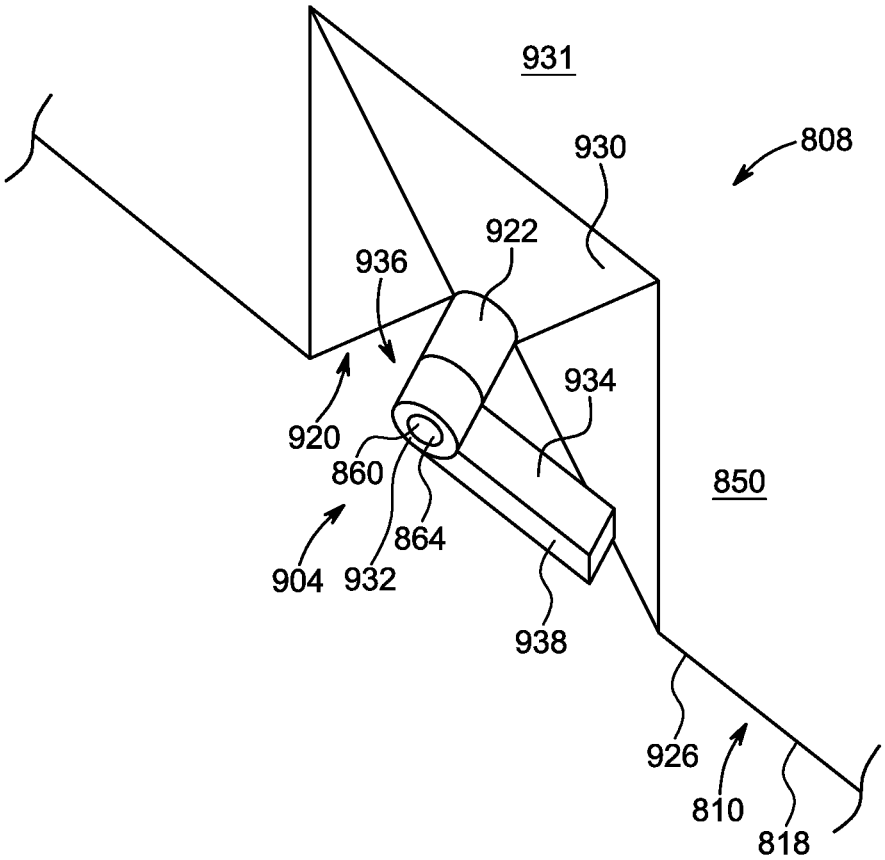
FIG. 28 is a magnified view of area A illustrated in FIG. 24.

As best shown in FIGS. 25, 27, and 28, the main body 812 defines a recess 920 and a projection 922. The recess 920 is cooperatively defined by the bottom wall 818 and the sidewall 820, extends into the main body 812, and is sized and configured to receive the projection 922, the valve 904, as described in more detail herein. The recess 920 is in fluid communication with the passageway 860. In the illustrated embodiment, the recess 920 extends into the sidewall first external surface 850 from the edge 926 between the sidewall first external surface 850 and the bottom wall 818 to a location between the edge 926 and the sidewall top end 838. The inclusion of recess 920 incorporates a sidewall first internal surface first portion 928, a sidewall first internal surface second portion 929, a sidewall first external surface first portion 930, and a sidewall first external surface second portion 931. The sidewall first internal surface first portion 928 extends the passageway 860 to the sidewall first internal surface second portion 929. The sidewall first external surface first portion 930 extends from the projection 922 to the sidewall first external surface second portion 931. The sidewall internal surface first portion 928 extends at a downward slope from the sidewall first internal surface second portion 929 to the passageway 860 and is disposed at an angle 933 relative to the sidewall first internal surface second portion 929 that is greater than 90 degrees and less than 180 degrees. The inclusion of a recess 920 is considered advantageous at least because it limits the structure that extends beyond the sidewall (e.g., the sidewall first external surface).

The bottom wall first internal surface 822 extends from the sidewall second internal surface 844, toward the sidewall first internal surface 842, to the passageway 860 such that the bottom wall first internal surface 822 is disposed at an angle relative to a portion of the sidewall 820 that defines the passageway 860 that is equal to 180 degrees such that the portion of the sidewall 820 that defines the passageway 860 is coplanar with the bottom wall first internal surface 822. The bottom wall first internal surface 822 extends from the sidewall second internal surface 844 to the passageway 860 at a downward slope, the bottom wall second internal surface 824 extends from the sidewall third internal surface 846 to the bottom wall first internal surface 822 and the sidewall first internal surface first portion 928 at a downward slope, and the bottom wall third internal surface 826 extends from the sidewall fourth internal surface 848 to the bottom wall first internal surface 822 and the sidewall first internal surface first portion 928 at a downward slope.

While the recess 920 has been illustrated as having a particular structural configuration and as being disposed at a particular location on the fluid container, a recess defined by the main body of a fluid container can have any suitable structural configuration and be positioned at any suitable location on a fluid container. Selection of a suitable structural configuration and location to position a recess can be based on various considerations, such as the material that forms the main body of a fluid container and/or the fluid intended on being disposed within a fluid container. Examples of structural arrangements considered suitable for a recess include structural arrangements that define a recess that has curved sides and/or define curved surfaces within a fluid holding cavity, that define a recess that has faceted sides and/or define faceted surfaces within a fluid holding cavity, and any other structural arrangement considered suitable for a particular embodiment. Examples of locations considered suitable to position a recess on a fluid container include such that the recess is disposed at equal distances from a first external surface of the fluid container and a second external surface of the fluid container, such that the recess is disposed a first distance from a first external surface of a fluid container and disposed a second distance from a second external surface of the fluid container that is equal to, less than, or greater than the first distance, such that the recess is disposed equal distances from a top end of a sidewall of the fluid container and a bottom end of the sidewall of the fluid container, such that the recess is disposed a first distance from a top end of a sidewall of a fluid container and disposed a second distance from a bottom end of the sidewall of the fluid container that is equal to, less than, or greater than the first distance, and/or any other locations considered suitable for a particular embodiment.

In the illustrated embodiment, the sidewall 820 defines the projection 922 that extends from the sidewall first external surface first portion 930 and away from the sidewall first internal surface first portion 928 to a projection end 932. The passageway 860 extends from a first opening 862 cooperatively defined by the bottom wall 818 (e.g., bottom wall first internal surface 842, bottom wall second internal surface 844, bottom wall third internal surface 846) and the sidewall 820 (e.g., sidewall first internal surface first portion 928) to a second opening 864 defined on the projection end 932. In the illustrated embodiment, the projection end 932 is disposed within the recess 920.

The valve 904 is positioned on the projection 922 and is operatively connected to an actuator 934 that is moveable between a first position, as shown in FIG. 28, and a second position, not shown. When the actuator 934 is in the first position, the valve 904 is in a closed configuration such that fluid disposed within the fluid holding cavity 866 cannot pass through the passageway 860. In the closed configuration, the valve 904 obstructs the passageway 860. When the actuator 934 is in the second position, the valve 904 is in an open configuration such that fluid disposed within the fluid holding cavity 866 can pass through the passageway 860 and out of the fluid container 810. In the open configuration, the valve 904 does not obstruct the passageway 860 such that the passageway 860 is open and unobstructed.

Figure 39:
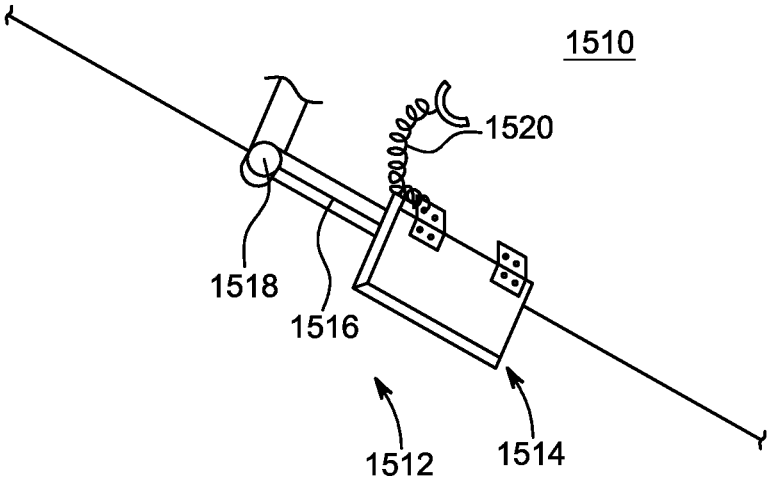
FIG. 39 is a perspective view of an example valve attached to a fluid container.

Any suitable valve having any suitable actuator can be included in a fluid container system and selection of a suitable valve and a suitable actuator can be based on various considerations, including the material intended to be disposed within a fluid container. Examples of valves considered suitable to include in a fluid container system include adjustable valves, ball valves, butterfly valve, globe valves, gate valves, diaphragm valves, binary valves, caps, valves that include elongate rods as actuators, valves that include hand wheels as actuators, stickers, flaps, and any other valve having any suitable actuator considered suitable for a particular embodiment. In the illustrated embodiment, the valve 904 is a butterfly valve 936 having an actuator 934 that is an elongate rod 938. In alternative embodiments, a valve included in a fluid container system can comprise a sticker that is moveable from a first configuration in which the sticker is adhered to a projection end and the passageway is obstructed to a second configuration in which the sticker has been removed from the projection end and the passageway is open such that fluid can flow through the passageway. In the closed configuration, the sticker is releasably attached to a fluid container and disposed over the passageway second opening such that it prevents movement of fluid disposed within the fluid holding cavity from passing through the passageway second opening. In the open configuration, the sticker is removed from the fluid container such that fluid disposed within the fluid holding cavity can pass through the passageway second opening. Alternatively, a valve included in a fluid container system can comprise a cap that is moveable from a first configuration to a second configuration. In the first configuration, the cap is releasably attached to a fluid container and disposed over the passageway second opening, and/or partially within the passageway, such that it prevents movement of fluid disposed within the fluid holding cavity from passing through the passageway second opening. In the second configuration, the cap is removed from the fluid container such that fluid disposed within the fluid holding cavity can pass through the passageway second opening. A valve and actuator included in a fluid container system can be disposed on the same portion of the fluid container (e.g., sidewall, projection) or such that the valve is disposed on a first portion of a fluid container system (e.g., sidewall, projection) and the actuator is disposed on a second portion of the fluid container system that is different than the first portion (e.g., lid, sidewall). FIG. 39 illustrates an example valve 1512 attached to a fluid container 1510. The valve 1512 includes an actuator 1514, and elongate shaft 1516, a plug 1518, and a spring 1520 that is attached at one end to the fluid container 1510 and at another end to the actuator 1514. The elongate shaft 1516 is attached at one end to the actuator 1514 and at the other end to the plug 1518. The actuator 1514 is moveable between first and second position and the plug 1518 is moveable between open and closed configurations. When a force is applied on the actuator 1514 that is directed toward the surface upon which the fluid container 1510 is disposed, the actuator 1514 moves to the second position and the plug 1518 moves to the open position such that fluid can pass through the passageway and out of the fluid holding cavity (not shown). When the force is released from the actuator 1514 (e.g., no force is being applied to the actuator), the spring 1520 moves the actuator 1514 to the first position (e.g., the actuator 1514 is biased to the first position) and the plug 1518 moves to the closed position (e.g., the plug is biased to the first position) such that fluid is prevented from passing through the passageway and out of the fluid holding cavity. Another example valve includes an elongate member that has a first end disposed at, or near the sidewall top end and a second end disposed adjacent to the passageway defined by the fluid container. The elongate member can be attached to the fluid container using any suitable structure (e.g., u-shaped staples, a tracked defined by the fluid container) and is moveable between first and second positions. When a force is applied on the first end of the elongate member that is directed away from the sidewall top end, the second end of the elongate member moves to the second position and is partially disposed over, or entirely free of, the passageway defined by the fluid container such that fluid can pass through the passageway and out of the fluid holding cavity. When a force is applied on the first end of the elongate member that is directed toward the sidewall top end, the second end of the elongate member moves to the first position and is partially disposed over, or entirely disposed over, the passageway defined by the fluid container such that fluid is prevented from passing through the passageway and out of the fluid holding cavity. This example valve positions can position the activator (e.g., the first end of the elongate member) at any suitable location on a fluid container (e.g., at the sidewall top end, near the sidewall top end, above the sidewall top end).

Figure 24:
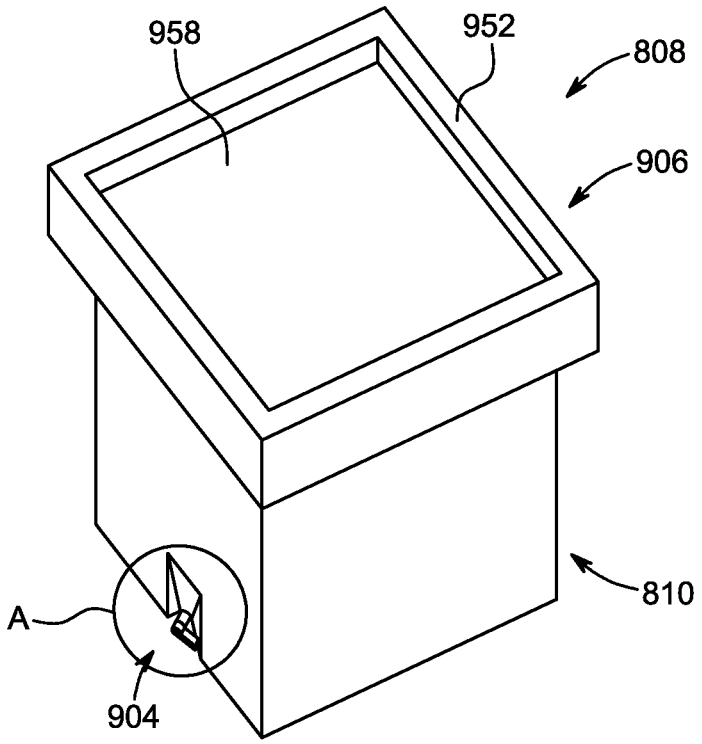
FIG. 24 is a perspective view of a first example fluid container system.
Figure 29:
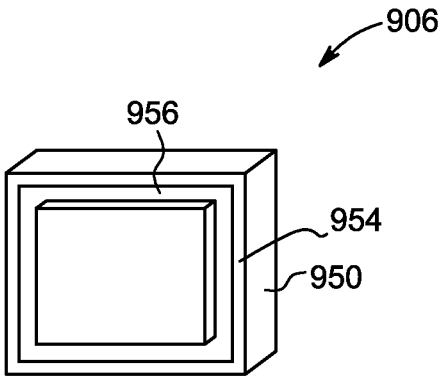
FIG. 29 is a bottom view of the lid of the fluid container system illustrated in FIG. 24.

As best shown in FIGS. 24 and 29, the lid 906 is releasably disposed on the fluid container 810 (e.g., sidewall 820) and has a lid main body 950 that defines a lid top surface 952, a lid bottom surface 954, a lid first recess 956, and lid second recess 958. The lid first recess 956 extends from the lid bottom surface 954, into the main body 950, and toward a hypothetical plane that contains a portion of the lid top surface 952. The lid first recess 956 is sized and configured to receive a portion of the fluid container 810 (e.g., sidewall 820) such that the lid 906 covers the fluid holding cavity 866 and prevents any fluid disposed within the fluid holding cavity 866 from passing through the fluid cavity opening 868. The lid second recess 958 extends from the lid top surface 952, into the main body 950, and toward a hypothetical plane that contains a portion of the lid bottom surface 954. The lid second recess 958 is sized and configured to receive a portion of a fluid container such that the fluid container can be positioned on top of the lid 906. This structural arrangement provides a mechanism for storing fluid containers vertically, one on top of another, for storage, shipping, and/or operational purposes.

While the lid 906 has been illustrated as having a particular structural arrangement, a lid included in a fluid container system can have any suitable structural arrangement and selection of a suitable structural arrangement for a lid can be based on various considerations, such as the structural arrangement of a fluid container. Examples of structural arrangements considered suitable for a lid include those that include a first recess and a second recess, only a first recess, only a second recess, a handle, a valve, an actuator, and any other structural arrangement considered suitable for a particular embodiment.

A valve and/or lid included in a fluid container system can be formed of any suitable material and selection of a suitable material to form a valve and/or lid according to a particular embodiment can be based on various considerations, including the fluid that is intended to be disposed within the fluid container. Examples of materials considered suitable to form a valve and/or lid include metals such as stainless steel, titanium, metal alloys, thermoplastics, polymers, nylon, polyethylene, high-density polyethylene (HDPE), high-performance polyethylene (HPPE), polyurethane, silicone, materials that have a rectangular, elongated, or square, cross-sectional configuration, combinations of those materials described herein, and any other material considered suitable for a particular embodiment. In the illustrated embodiment, the valve 904 is formed of a polymer and the lid 906 is formed of a polymer. Alternative embodiments, however, can include a fluid container that has a main body that is formed of a first material and a lid that is formed of a second material that is different than the first material.

Figure 38:
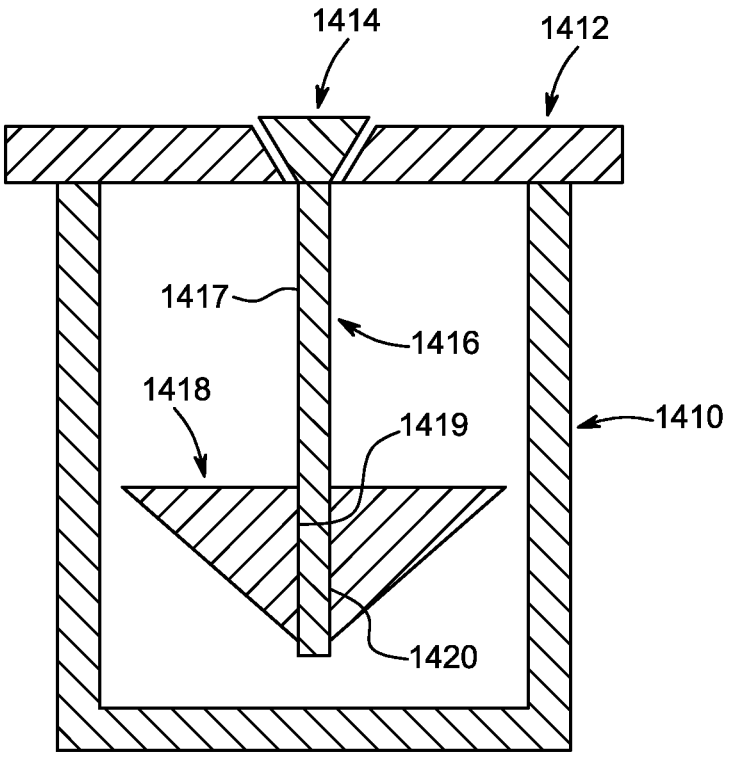
FIG. 38 is a sectional view of a third example fluid container system taken along the lengthwise axis of the fluid container.

A lid and/or a fluid container included in a fluid container system can include any suitable structure capable of providing releasable attachment between a lid and a fluid container and/or capable of providing for the removal of fluid disposed within the fluid holding cavity. Selection of suitable structure considered suitable to include on a lid and/or fluid container can be based on various considerations, such as the material that forms a lid and/or fluid container. Examples of suitable structures considered suitable to include on a lid and/or fluid container to provide releasable attachment between a lid and a fluid container include snap fit structures, threaded structures, and any other structure considered suitable for a particular embodiment. Examples of suitable structures considered suitable to include on a lid to provide for the removal of fluid disposed within a fluid holding cavity include pressure relief valves, pressure control valves, and any other structure considered suitable for a particular embodiment. For example, a fluid holding cavity can include a compression system that include a handle disposed outside of the fluid holding cavity, a threaded elongate member attached to the handle and disposed through the lid and partially disposed within the fluid holding cavity, and a plate disposed within the fluid holding cavity and attached to the threaded elongate member. Upon movement of the handle in a first direction, the plate moves toward the bottom end of the fluid holding cavity such that any fluid disposed within the fluid holding cavity will become pressurized and will flow through the passageway when the passageway is unobstructed (e.g., any attached valve is moved to its open configuration). Upon movement of the handle in a second direction, the plate moves toward the top end of the fluid holding cavity such that any fluid disposed within the fluid holding cavity is subject to gravitational forces and will flow through the passageway when the passageway is unobstructed (e.g., any attached valve is moved to its open configuration). As shown in FIG. 38, the fluid container 1410 includes a lid 1412, a handle 1414, a threaded elongate member 1416 that defines threads 1417, and a plate 1418 that defines threads 1419 within a passageway 1420 that are sized and configured to mate with the threads 1417 of the threaded elongate member 1416. The handle 1414 can define any suitable structure capable of allowing a user to rotate the handle in first and second directions to move the plate 1418 (e.g., finger depressions, handle that defines passageway sized and configured to receive one or more of a users fingers). Alternatively, a handle can define structure capable of attachment to another feature, device, or system, such as a drill press, that can be manually our automated activated such that a predefine amount of fluid contained within the fluid holding cavity can be dispensed from the fluid container. This can be accomplished, for example, by including a valve on the fluid container that is in communication with the passageway defined by the sidewall that is pressure activated (e.g., pressure relief valve, pressure-control valve, a valve that opens under a predetermined amount of pressure being applied to the fluid holding cavity or a liner fluid holding cavity). While the plate 1418 has been illustrated as having a particular structural arrangement, a plate can have any suitable structural arrangement (e.g., plate can comprise an elongate member).

Alternative embodiments can include a handle extending from a portion of a fluid container and/or lid that provides a mechanism for carrying, holding, and/or transporting a fluid container or fluid container system. For example, a handle that defines an opening sized and configured to receive a portion of the hand of user can be disposed on an external surface of a sidewall and/or a lid top surface. The handle can be formed of the same material that forms a fluid container or lid to which it is attached such that it is an integrated component of the fluid container or lid. Alternatively, a handle can be a separate component attached to the fluid container or lid and/or can be formed of a material that is different than the material that forms a fluid container and/or lid.

FIGS. 30, 31, 32, 33, 34, and 35 illustrate a second example fluid container system 1008. The fluid container system 1008 has a fluid container 1010, a valve 1104, a lid 1106, a liner 1108, and an attachment screw 1110. The fluid container 1010 is similar to the fluid container 710 illustrated in FIGS. 21, 22, and 23 and described above, except as detailed below.

In the illustrated embodiment, the main body 1012 defines a recess 1120 and a projection 1122. The recess 1120 extends into the bottom wall 1018 and the sidewall 1120 and is sized and configured to receive a portion of the projection 1122, as described in more detail herein. In the illustrated embodiment, the recess 1120 extends into the sidewall first external surface 1050 from the edge 1126 between the sidewall first external surface 1050 and the bottom wall 1018 to a location between the edge 1126 and the sidewall top end 1038. The inclusion of recess 1120 incorporates a sidewall first internal surface first portion 1128, a sidewall first internal surface second portion 1129, a sidewall first external surface first portion 1130, and a sidewall first external surface second portion 1131. The sidewall first internal surface first portion 1128 extends from the sidewall first internal surface second portion 1129 to the passageway 1060. The sidewall first external surface first portion 1130 extends from the sidewall first external surface second portion 1131 to the projection 1122. The sidewall first internal surface first portion 1128 extends at a downward slope from the sidewall first internal surface second portion 1129 to the passageway 1060 and is disposed at an angle 1133 relative to the sidewall first internal surface second portion 1129 that is greater than 90 degrees and less than 180 degrees.

The bottom wall first internal surface 1022 extends from the sidewall second internal surface 1044, toward the sidewall first internal surface 1042, to the passageway 1060 such that the bottom wall first internal surface 1022 is disposed at an angle relative to a portion of the sidewall 1020 that defines the passageway 1060 that is greater than 90 degrees and less than 180 degrees. The bottom wall first internal surface 1022 extends from the sidewall second internal surface 1044 to the passageway 1060 at a downward slope.

In the illustrated embodiment, the sidewall 1020 defines the projection 1122 that extends from the sidewall first external surface first portion 1130 and away from the sidewall first internal surface 1042 to a projection end 1132. The passageway 1060 extends from a first opening 1062 cooperatively defined by the bottom wall 1018 (e.g., bottom wall first internal surface 1042) and the sidewall 1020 (e.g., sidewall first internal surface first portion 1028) to a second opening 1064 defined on the projection end 1132. In the illustrated embodiment, the projection end 1132 is disposed outside of recess 1120 and the projection 1122 defines an internal thread 1140 that extends from the first opening 1062 toward the second opening 1064. The internal thread 1140 is sized and configured to mate and interact with the external thread 1190 of the attachment screw 1110, as described in more detail herein.

In the illustrated embodiment, the first support leg 1014 defines a sinusoidal configuration and has a first support leg first end 1072, a first support leg first height 1078, a first support leg second end 1076, a first support leg second height 1074, a first support leg bottom surface 1080, a first support leg length that extends from the first support leg first end 1072 to the first support leg second end 1074, a first support leg external surface 1084, and a first support leg internal surface 1086. In the illustrated embodiment, the first support leg first height 1078 is less than the first support leg second height 1074. The first support leg 1014 extends from the main body 1012 such that the first support leg first end 1072 is coplanar with the sidewall third external surface 1054, the first support leg second end 1076 is coplanar with the sidewall fourth external surface 1056, and the first support leg external surface 1084 is coplanar with the sidewall second external surface 1052.

The valve 1104 is positioned on the projection 1122 and has an actuator 1134 that is moveable between a first position and a second position. When the actuator 1134 is in the first position, the valve 1104 is in a closed configuration such that fluid disposed within the fluid holding cavity 1066 cannot pass through the passageway 1060. When the actuator 1134 is in the second position, the valve 1104 is in an open configuration such that fluid disposed within the fluid holding cavity 1066 can pass through the passageway 1060 and out of the fluid container 1010. In the illustrated embodiment, the valve 1104 is a ball valve 1136 having an actuator 1134 that is a hand wheel 1138.

In the illustrated embodiment, the lid 1106 has a lid main body 1150 that defines a lid top surface 1152, a lid bottom surface 1154, and a lid first recess 1156. The lid first recess 1156 extends from the lid bottom surface 154, into the main body 150, and toward the lid top surface 1152. The lid first recess 1156 is sized and configured to receive a portion of the fluid container 1010 (e.g., sidewall 1020) and the liner 1108 such that the lid 1106 covers the fluid holding cavity 1066 and prevents any fluid disposed within the fluid holding cavity 1066 from passing through the fluid cavity opening 1068.

Figure 30:
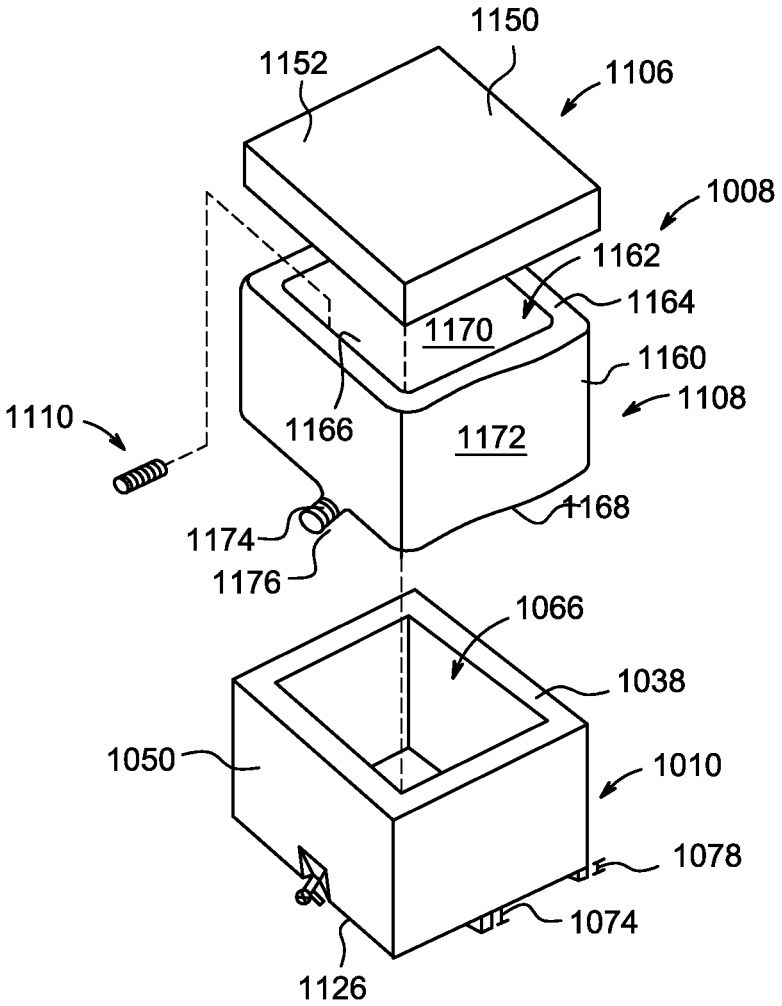
FIG. 30 is a partially exploded perspective view of a second example fluid container system.
Figure 31:
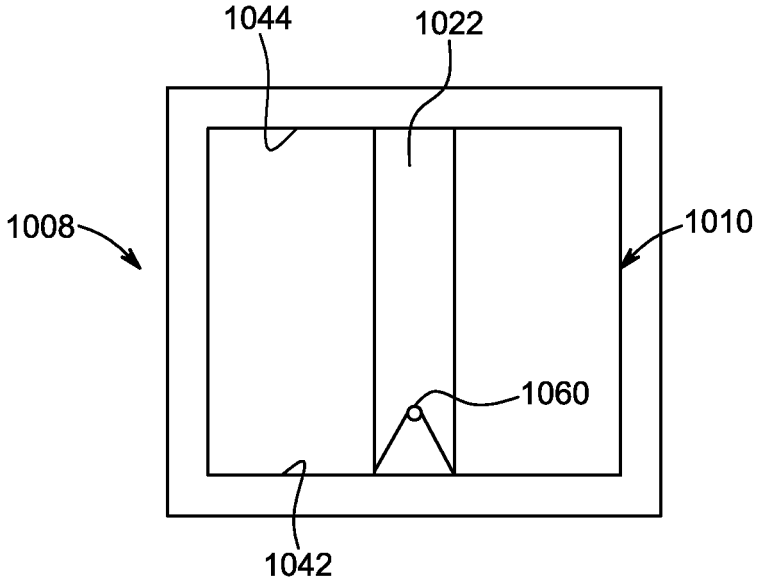
FIG. 31 is a top view of the fluid container of the fluid container system illustrated in FIG. 30.
Figure 32:
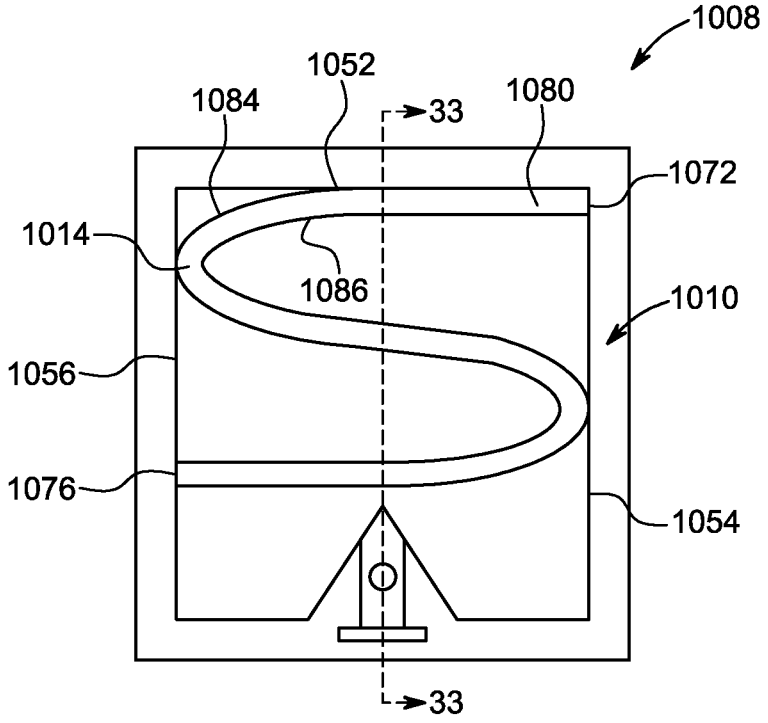
FIG. 32 is a bottom view of the fluid container system illustrated in FIG. 30.
Figure 33:
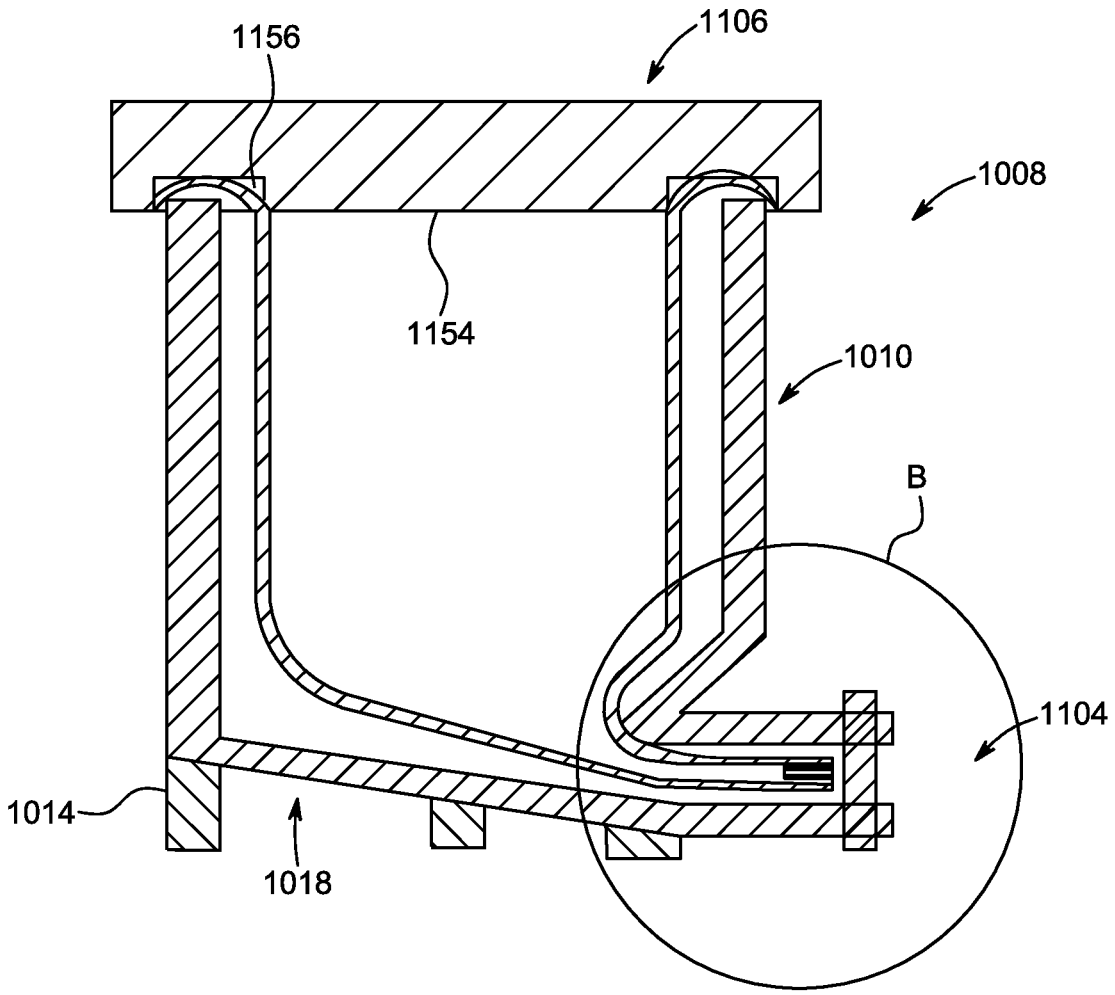
FIG. 33 is a sectional view of the fluid container illustrated in FIG. 32 taken along line 33-33.
Figure 34:
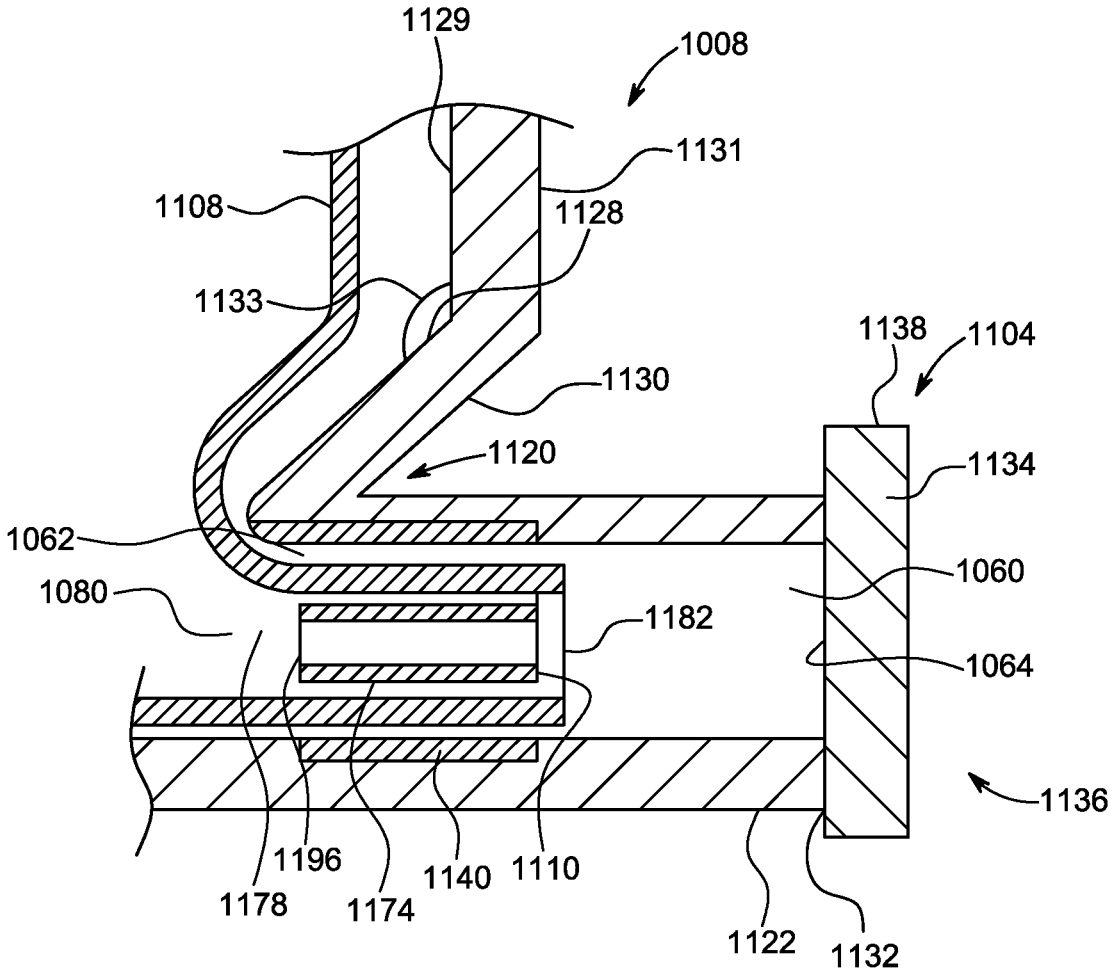
FIG. 34 is a magnified view of area B illustrated in FIG. 33.

As best shown in FIGS. 30 and 34, the liner 1108 is partially disposed within the fluid holding cavity 1066 and the passageway 1060 and between the fluid container 1010 and the attachment screw 1110. The liner 1108 has a main body 1160 that defines a liner fluid holding cavity 1162, a liner top end 1164, a liner top opening 1166, a liner bottom end 1168, a liner internal surface 1170, a liner exterior surface 1172, a liner projection 1174, a liner projection end 1176, a liner passageway 1178, a liner first opening 1180, and a liner second opening 1182. The liner 1108 is sized and configured to receive a fluid. The liner top end 1164 is disposed outside of the fluid holding cavity 1066 such that a portion of the liner 1108 extends over the sidewall top end 1038 and is positioned between the fluid container 1010 and the lid 1106 such that the liner 1108 is releasably attached to the fluid container 1010. Alternative embodiments, however, can include a liner that is entirely disposed within a fluid holding cavity. The liner projection 1174 is disposed adjacent the liner bottom end 1168 and extends from the liner main body 1160 and away from the liner fluid holding cavity 1162 to the liner projection end 1176. The liner passageway 1178 is in communication with the liner fluid holding cavity 1162 and extends from the liner first opening 1180 defined on the liner internal surface 1170 to the liner second opening 1182 defined on the liner projection end 1176 such that the liner passageway 1178 extends through the liner projection 1174 and is in fluid communication with the liner fluid holding cavity 1162. A portion of the liner passageway 1178 is disposed at an angle to a portion of the liner internal surface 1170 at the liner bottom end 1168 such that fluid disposed within the liner 1108 can pass through the liner passageway 1178 and out of the liner 1108. In the illustrated embodiment, the liner projection 1174 is disposed within the passageway 1060 and is configured to be releasably attached to the fluid container 1010 using the attachment screw 1110.

A liner, such as liner 1106, can be included in any suitable fluid container and/or fluid container system, such as fluid container 10, fluid container 110, fluid container 210, fluid container 310, fluid container 510, fluid container 610, fluid container 710, fluid container system 808, fluid container system 1008, fluid container system 1308, fluid container 1410 and associated structure, fluid container 1510 and associated structure, fluid container 1610 and associated structure, variations of the fluid containers or fluid container systems described herein, and any other fluid container or fluid container system considered suitable for a particular embodiment.

While the liner 1108 has been illustrated as having a particular structural arrangement a liner included in a fluid container system can have any suitable structural arrangement, can be formed of any suitable material having any suitable degree of opaqueness or translucency, color, and/or thickness, and can be attached to a fluid container using any suitable technique and/or method of attachment. Selection of a suitable structural arrangement and material to form a liner can be based on various considerations, including the fluid and/or materials that is/are intended to be disposed within the fluid container. Examples of materials considered suitable to form a liner include thermoplastics, polymers, nylon, polyethylene, high-density polyethylene (HDPE), high-performance polyethylene (HPPE), polyurethane, silicone, combinations of those materials described herein, and any other material considered suitable for a particular embodiment. In the illustrated embodiment, the liner 1106 is formed of a material (e.g., polymer) that is relatively more flexible than the material that forms the fluid container 1010. Examples of degrees of opaqueness or translucency considered suitable for a material that forms a liner include materials that are transparent, semi-transparent, opaque, semi-opaque, and any other degree of opaqueness or translucency considered suitable for a particular embodiment. Examples of colors considered suitable to form a liner include black, white, red, blue, grey, green, yellow, combinations of those described herein, and any other color considered suitable for a particular embodiment. For example, if one or more plants are disposed within a liner, the material forming the liner should not be transparent and should be opaque and/or black to avoid light being disposed on the fluid and/or material (e.g., roots of plants) disposed within the liner. Examples of techniques and methods of attachment considered suitable between a liner and a fluid container and/or lid include pinching a liner between a fluid container and lid, fusing a liner to a fluid container, adhering a liner to the fluid container and/or lid, placing a liner on one or more attachment members, such as hooks or hangers, disposed on a fluid container and/or lid, and any other technique or method considered suitable for a particular embodiment. Examples of thicknesses considered suitable to for a liner include thicknesses that are constant along the length and/or width of the liner, thicknesses that vary along the length and/or width of the liner, thicknesses that are equal to, substantially equal to, about equal to, less than, or greater than 0.0001 inches, 0.0002 inches, between about 0.0001 inches and about 0.001 inches, between about 0.0001 inches and about 0.01 inches, and any other thickness considered suitable for a particular embodiment.

While the liner projection end 1176 has been illustrated as disposed within the passageway 1060, a liner projection end can be positioned at any suitable location relative to a fluid container and selection of a suitable location to position a liner projection end can be based on various considerations, including the type of fluid intended to be disposed within a liner fluid holding cavity. Example locations considered suitable to position a liner projection end include within a passageway defined by a fluid container, outside of a passageway defined by a fluid container, disposed flush with an end of a passageway defined by a fluid container, disposed flush with a projection end, and any other location considered suitable for a particular embodiment. In alternative embodiments, a liner projection end can define a closed end such that any fluid disposed within the liner fluid holding cavity cannot pass through the liner passageway until the closed end has been opened. A closed liner projection end can be opened using any suitable structure, such as a needle or other pointed structure that can puncture the closed end (e.g., a needle or other pointed structure that is attached to an end of a valve or screw that is intended to be attached to the fluid container such that the needle or pointed structure is passed into the passageway defined by the fluid container upon attachment of the valve or screw to the fluid container).

Figure 35:
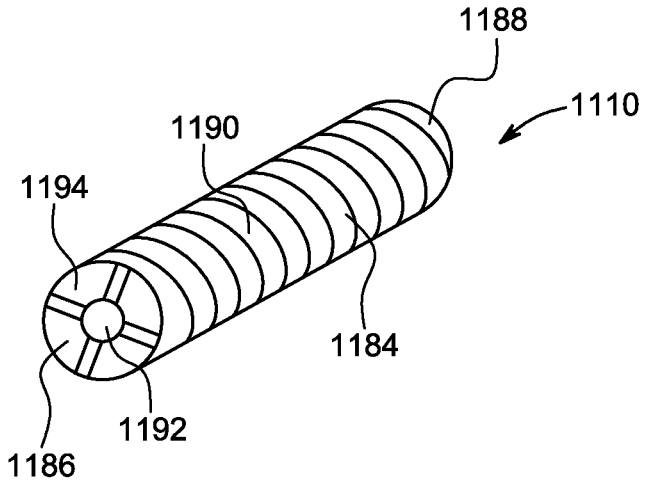
FIG. 35 is a perspective view of the attachment screw of the fluid container system illustrated in FIG. 30.

In the illustrated embodiment, and as shown in FIGS. 34 and 35, the attachment screw 1110 is disposed within the liner passageway 1178 and has a main body 1184 that defines a first end 1186, a second end 1188, an exterior thread 1190, a passageway 1192, a first opening 1194, and a second opening 1196. The exterior thread 1190 extends from the first end 1186 to the second end 1188 and is sized and configured to mate and interact with the liner 1108 and the thread 1140 defined by the fluid container 1010. The passageway 1192 extends from the first opening 1194 to the second opening 1196 and is in fluid communication with the liner fluid holding cavity 1162 and an environment outside of the liner fluid holding cavity 1162 and the fluid holding cavity 1066. The attachment screw 1110 can include any suitable structure on the first end 1186 that is sized and configured to receive a portion of a tool, such as the end of a screwdriver, such that the attachment screw 1110 can be inserted into the liner passageway 1178 and releasably attached to the fluid container 1010.

Figure 36:
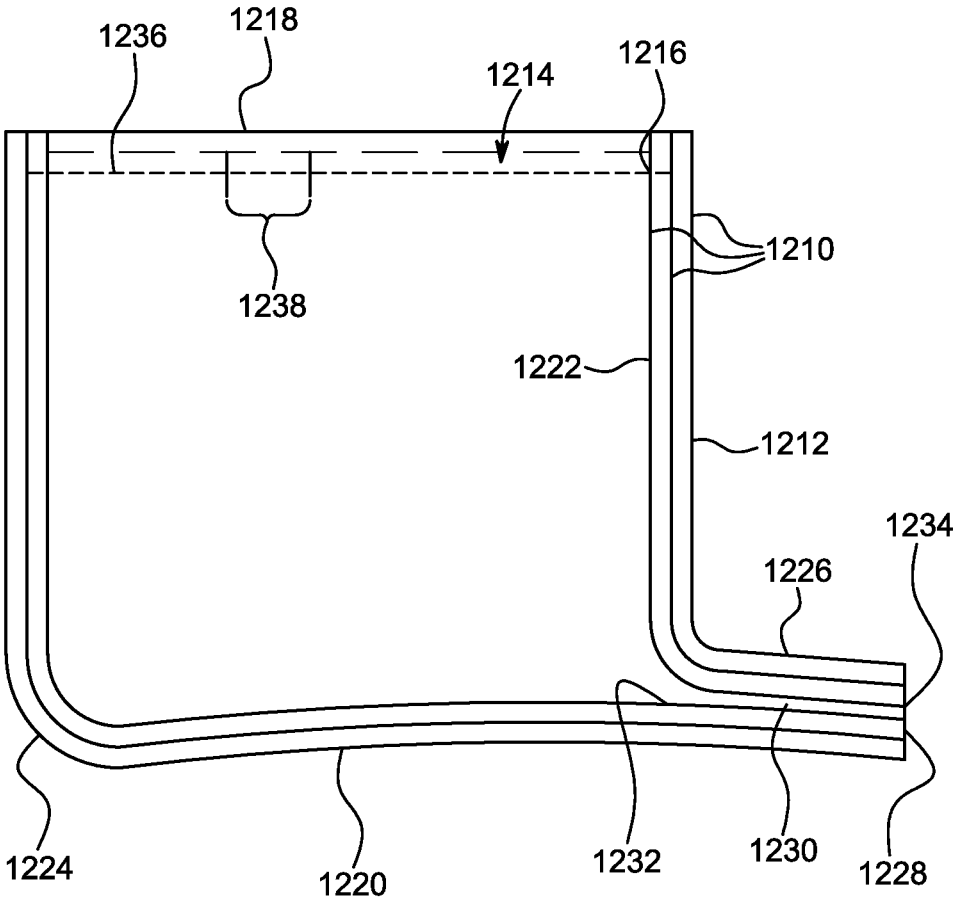
FIG. 36 is a sectional view of a plurality of liners that can be included in a fluid container system.

FIG. 36 illustrates a plurality of liners 1210 that can be included in a fluid container system. Each liner of the plurality of liners 1210 has a main body 1212 that defines a liner fluid holding cavity 1214, a liner top end 1216, a liner top opening 1218, a liner bottom end 1220, a liner internal surface 1222, a liner exterior surface 1224, a liner projection 1226, a liner projection end 1228, a liner passageway 1230, a liner first opening 1232, a liner second opening 1234, and a liner perforation 1236.

In the illustrated embodiment, a liner of the plurality of liners 1210 is attached to an adjacent liner of the plurality of liners 1210 by a plurality of staples 1238. Each staple of the plurality of staples 1238 is disposed between the liner top end 1216 and the liner perforation 1236 such that a liner of the plurality of liners 1210 can be removed from the plurality of liners 1210 by applying a force on the liner directed outside of the liner fluid holding cavity 1214 and tearing the liner along the liner perforation 1236.

While a liner of the plurality of liners 1210 has been illustrated as attached to an adjacent liner of the plurality of liners 1210 using a plurality of staples 1238, a liner can be attached to another liner, or a plurality of liners, using any suitable technique or method of attachment. Selection of a suitable technique or method of attachment to attach a liner to another liner, or a plurality of liners, can be based on various considerations, such as the material(s) that forms a liner. Examples of techniques and methods of attachment considered suitable between a liner and another liner, or a plurality of liners, include welding, fusing, using adhesive, using one or more staples, and any other technique or method considered suitable for a particular embodiment.

Figure 37:
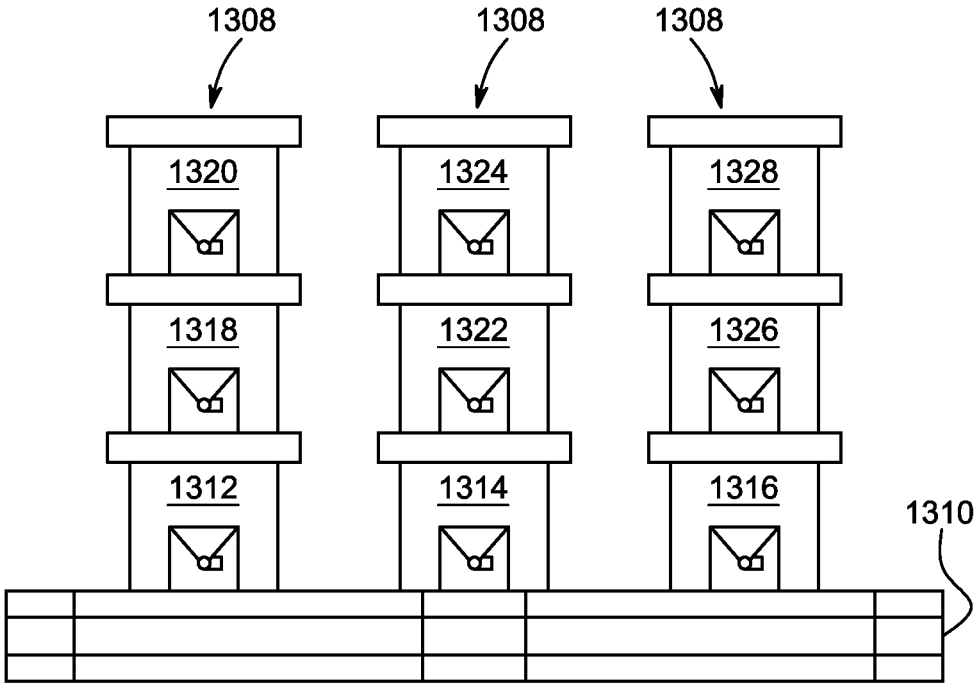
FIG. 37 is an elevation view of a plurality of fluid container systems disposed on a shipping pallet.

FIG. 37 illustrates a plurality of fluid container systems 1308, according to an embodiment, such as fluid container system 808 illustrated in FIGS. 24, 25, 26, and 27, disposed on a shipping pallet 1310. A first fluid container system 1312, a second fluid container system 1314, and a third fluid container system 1316 of the plurality of fluid container systems 1308 are disposed on the shipping pallet 1310. A fourth fluid container system 1318 is disposed on the first fluid container system 1312 and a fifth fluid container system 1320 is disposed on the fourth fluid container system 1318 such that the fourth fluid container system 1318 is disposed between the first fluid container system 1312 and the fifth fluid container system 1320. A sixth fluid container system 1322 is disposed on the second fluid container system 1314 and a seventh fluid container system 1324 is disposed on the sixth fluid container system 1322 such that the sixth fluid container system 1322 is disposed between the second fluid container system 1314 and the seventh fluid container system 1324. An eighth fluid container system 1326 is disposed on the third fluid container system 1316 and a ninth fluid container system 1328 is disposed on the eighth fluid container system 1326 such that the eighth fluid container system 1326 is disposed between the third fluid container system 1316 and the ninth fluid container system 1328.

While a plurality of fluid container systems 1308 has been illustrated as disposed on a shipping pallet 1310, any suitable number, and type, of fluid container systems and/or fluid containers can be disposed on a shipping pallet. Selection of a suitable number of fluid container systems and/or fluid containers to include on a shipping pallet according to a particular embodiment can be based on various considerations, such as the fluid intended to be disposed within each fluid container. Examples of suitable numbers of fluid container systems and/or fluid containers to include on a shipping pallet include at least one, one, two, a plurality, three, four, five, six, seven, eight, nine, ten, more than ten, more than twenty, more than fifty, and any other number considered suitable for a particular embodiment.

Furthermore, while fluid container system 808 has been illustrated as disposed on shipping pallet 1310, any suitable fluid container system and/or fluid container can be included on a shipping pallet. Selection of a suitable fluid container system and/or fluid container to include on a shipping pallet according to a particular embodiment can be based on various considerations, such as the fluid intended to be disposed within a fluid container. Examples of fluid container systems considered suitable to include on a shipping pallet include fluid container system 808, fluid container system 1008, variations of the fluid container systems described herein, and/or any other fluid container system considered suitable for a particular embodiment. Examples of fluid containers considered suitable to include on a shipping pallet include fluid container 10, fluid container 110, fluid container 210, fluid container 310, fluid container 510, fluid container 610, fluid container 710, fluid container 1410 and associated structure, fluid container 1510 and associated structure, fluid container 1610 and associated structure, variations of the fluid containers described herein, and/or any other fluid container considered suitable for a particular embodiment.

While a shipping pallet 1310 has been illustrated as being disposed under the plurality of fluid container systems 1308, any suitable portable platform can be positioned under one or more fluid container systems according to an embodiment, such as fluid container system 808, fluid container system 1008, and/or a fluid container according to an embodiment, such as fluid container 10, fluid container 110, fluid container 210, fluid container 310, fluid container 510, fluid container 610, fluid container 710, fluid container 1410 and associated structure, fluid container 1510 and associated structure, fluid container 1610 and associated structure, variations of the fluid container systems and fluid containers described herein, and/or any other fluid container system and/or fluid container considered suitable for a particular embodiment. Selection of a suitable portable platform to position under one or more fluid container systems and/or fluid containers can be based on various considerations, such as the material that forms a fluid container and/or the material that is intended to be disposed within a fluid holding cavity. Examples of portable platforms considered suitable to position under one or more fluid container systems and/or fluid containers include pallets, wood pallets, polymer pallets, metal pallets, coated foam pallets, corrugated pallets, elongated metal, polymer, and/or wood sheets, and any other portable platform considered suitable for a particular embodiment.

Figure 40:
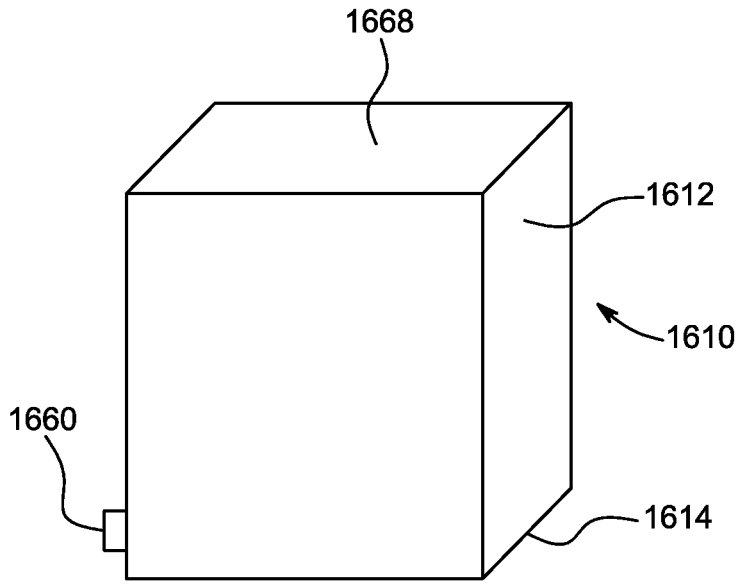
FIG. 40 is a perspective view of an eighth example fluid container.

FIG. 40 illustrates another example fluid container 1610. The fluid container 1610 is similar to the fluid container 10 illustrated in FIGS. 1, 2, 3, and 4 and described above, except as detailed below. The fluid container 1610 has a main body 1612, and a first support leg 1614.

In the illustrated embodiment, the fluid container 1610 has a closed top end 1668 such that the passageway 1660 is used as both the fill point to introduce fluids into the fluid holding cavity (not shown) and the discharge point such that fluid can be dispensed from the fluid holding cavity. Alternative embodiments can include a liner in the fluid holding cavity that can include a projection that is used as both the fill point and the discharge point, as described herein.

Figure 41:
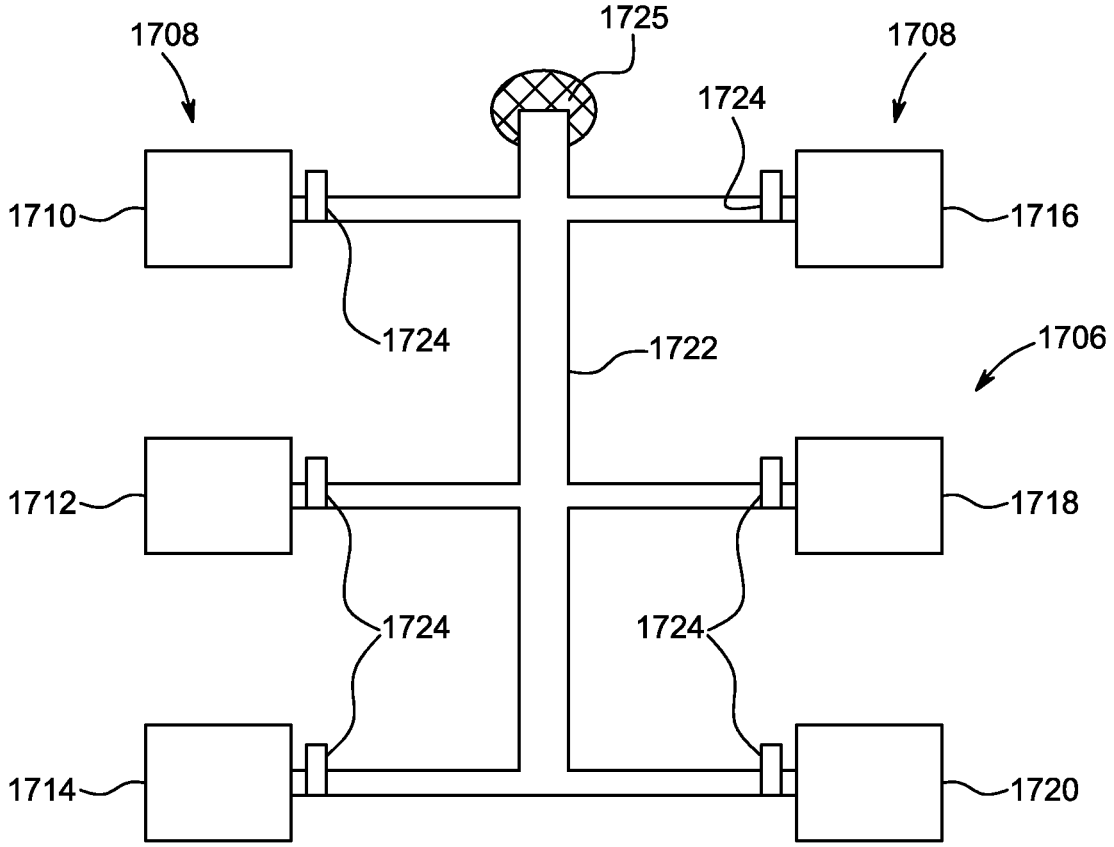
FIG. 41 is a top view of a system that includes a plurality of fluid container systems.

FIG. 41 illustrates a system 1706 that includes a plurality of fluid container systems 1708, according to an embodiment, such as fluid container system 808 illustrated in FIGS. 24, 25, 26, and 27, in communication with one another. The system 1706 includes a first fluid container system 1710, a second fluid container system 1712, a third fluid container system 1714, a fourth fluid container system 1716, a fifth fluid container system 1718, a sixth fluid container system 1720, and a tubular member 1722. The tubular member 1722 has a plurality of ends 1724 and each end of a set of the plurality of ends 1724 is in communication with the liner fluid holding cavity of a fluid container system via the passageway defined by the fluid container and the passageway defined by the liner. Another end of the plurality of ends 1724 is disposed over a floor drain 1725 such that fluid disposed within the fluid containers can be drained. This configuration is considered advantageous at least because it provides a mechanism for draining the fluid contained in a liner fluid holding cavity, or a fluid container fluid holding cavity, of multiple fluid containers. In alternative embodiments, each end of a set of the plurality of ends of a tubular member can be in communication with a fluid container fluid holding cavity via the passageway defined by the fluid container. Each end of the tubular member 1722 can be attached to a fluid container system using any suitable structure and technique or method of attachment. Examples of suitable structures, techniques, and methods of attachment considered suitable between a tubular member and a fluid container system include threaded connections, male and/or female PVC connectors, snap fit connectors, friction fit connectors, barbs, using adhesive, and any other structure, technique, or method of attachment considered suitable for a particular embodiment.

While the system has been illustrated as including a plurality of fluid container systems 1710, 1712, 1714, 1716, 1718, and 1720, any suitable number, and type, of fluid container systems and/or fluid containers can be included in a system. Selection of a suitable number of fluid container systems and/or fluid containers to include in a system according to a particular embodiment can be based on various considerations, such as the fluid intended to be disposed within each fluid container. Examples of suitable numbers of fluid container systems and/or fluid containers to include in a system include at least one, one, two, a plurality, three, four, five, six, seven, eight, nine, ten, more than ten, more than twenty, more than fifty, and any other number considered suitable for a particular embodiment.

A tubular member 1722 included in a system can be formed of any suitable material and selection of a suitable material to form a tubular member according to a particular embodiment can be based on various considerations, including the fluid that is intended to be disposed within the fluid container. Examples of materials considered suitable to form a tubular member include metals such as stainless steel, titanium, metal alloys, thermoplastics, polymers, nylon, polyethylene, high-density polyethylene (HDPE), high-performance polyethylene (HPPE), polyurethane, polyvinyl chloride (PVC), silicone, materials that have a rectangular, elongated, or square cross-sectional configuration, combinations of those materials described herein, and any other material considered suitable for a particular embodiment. In the illustrated embodiment, the tubular member is formed of PVC.

Various methods of using a fluid container are described herein. While the methods described herein are shown and described as a series of acts, it is to be understood and appreciated that the methods are not limited by the order of acts, as some acts may in accordance with these methods, occur in different orders, and/or concurrently with other acts described herein.

Figure 42:
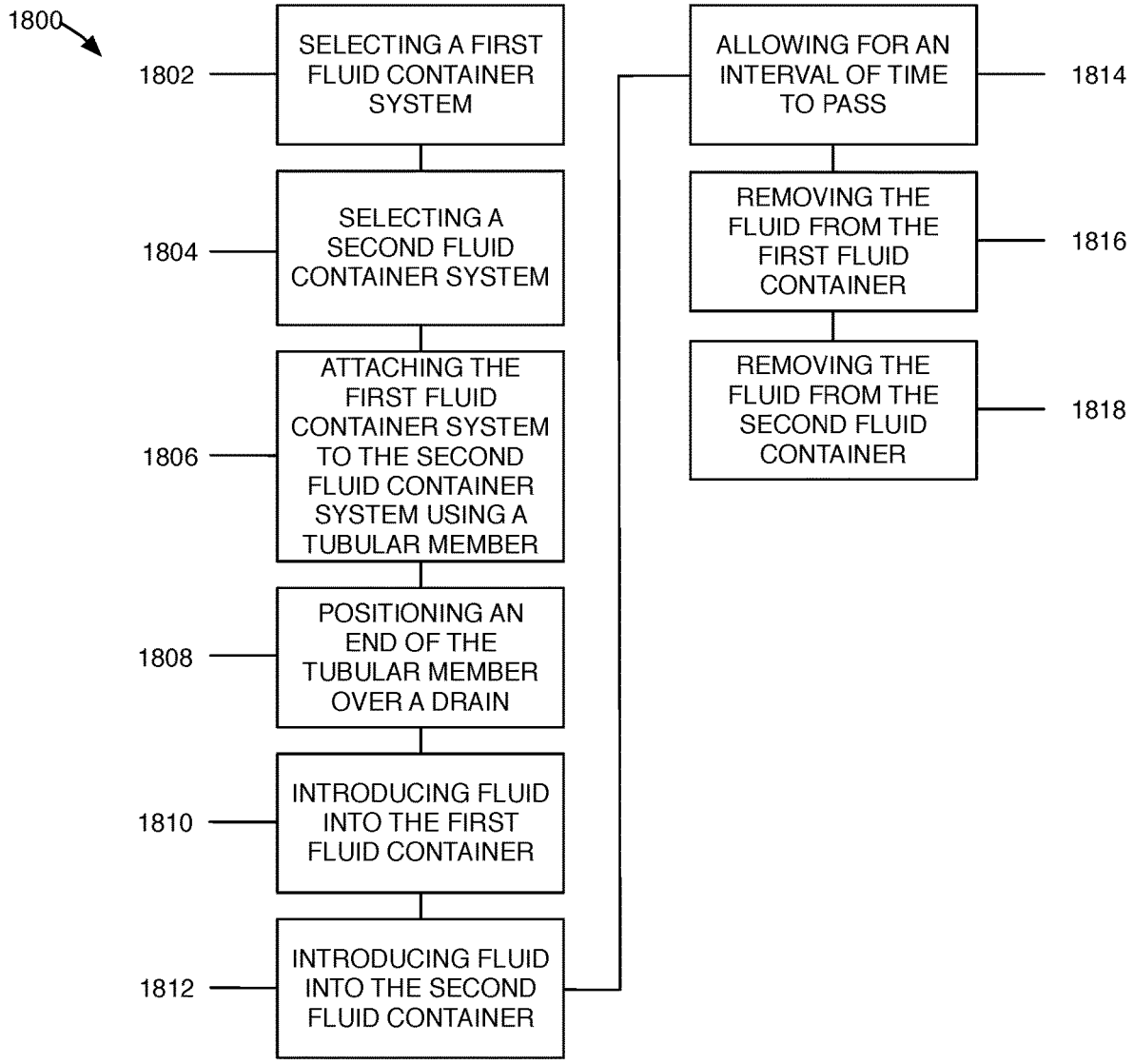
FIG. 42 is a schematic illustration of an example method of using a fluid container.

FIG. 42 is a schematic illustration of a method 1800 of using a fluid container.

An initial step 1802 comprises selecting a first fluid container system. Another step 1804 comprises selecting a second fluid container system. Another step 1806 comprises attaching the first fluid container system to the second fluid container system using a tubular member such that the fluid holding cavities of each fluid container system is in communication with the passageway defined by the tubular member. Another step 1808 comprises positioning an end of the tubular member over a drain. Another step 1810 comprises introducing a fluid into the first fluid container. Another step 1812 comprises introducing a fluid into the second fluid container. Another step 1814 comprises allowing for an interval of time to pass. Another step 1816 comprises removing the fluid from the first fluid container system. Another step 1818 comprises removing the fluid from the second fluid container system.

Each of steps 1802 and 1804 can be accomplished by selecting any suitable fluid container system and selection of a suitable fluid container system can be based on various considerations, such as the fluid intended to be introduced into a fluid holding cavity or a liner holding cavity. Examples of suitable fluid container systems considered suitable include fluid container system 808, fluid container system 1008, fluid container system 1308, variations of the fluid container systems described herein, and any other fluid container system considered suitable for a particular embodiment. A fluid container system included in the method 1800 described herein can include any suitable fluid container, such as fluid container 10, fluid container 110, fluid container 210, fluid container 310, fluid container 510, fluid container 610, fluid container 710, fluid container 1410 and associated structure, fluid container 1510 and associated structure, fluid container 1610 and associated structure, variations of the fluid containers described herein, and any other fluid container considered suitable for a particular embodiment. Any of the fluid containers, or fluid container systems, included in method 1800 can include, or omit the inclusion of, a liner, as described herein.

While the method 1800 has been described as being accomplished using first and second fluid container systems, any suitable number, and type, of fluid container systems and/or fluid containers can be included in a method of using a fluid container. Selection of a suitable number of fluid container systems and/or fluid containers to include in a method according to a particular embodiment can be based on various considerations, such as the fluid intended to be disposed within each fluid container. Examples of suitable numbers of fluid container systems and/or fluid containers to include in a method include at least one, one, two, a plurality, three, four, five, six, seven, eight, nine, ten, more than ten, more than twenty, more than fifty, and any other number considered suitable for a particular embodiment. Each fluid container and/or fluid container system included in a method can be attached to one another using a tubular member, as described herein.

Step 1806 can be accomplished using any suitable tubular member, such as those described with respect to FIG. 41, and using any suitable structure, technique, or method of attachment between the tubular member and a fluid container system, such as those described herein.

Step 1808 can be accomplished by positioning an end of the plurality of ends of a tubular member over a drain, or within a drain. As illustrated in FIG. 41, an end of the plurality of ends is positioned over a floor drain 1725.

Each of steps 1810 and 1812 can be accomplished by introducing a fluid into a fluid holding cavity (e.g., fluid holding cavity, liner fluid holding cavity). Any suitable fluid can be introduced into a fluid holding cavity and selection of a suitable fluid can be based on various considerations, such as the intended use of the system. Examples of fluids considered suitable to introduce into a fluid holding cavity include water, mixtures that include water, shampoo, conditioner, wastewater, consumable fluids, such as milk, soap, gasoline, oil, and any other fluid considered suitable for a particular embodiment. For example, a first fluid can be introduced into the first fluid container and a second fluid, that is the same or different than the first fluid, can be introduced into the second fluid container.

The step 1814 of allowing an interval of time to pass can be accomplished by completing step 1810 and/or step 1812 and waiting for an interval of time to pass before completing step 1816 and/or step 1818. Any suitable interval of time is considered suitable and selection a suitable interval of time according to a particular embodiment can be based on various considerations, including the intended use of the fluid containers. Examples of intervals of time considered suitable include, but are not limited to, allowing one or more seconds, one or more minutes, one or more hours, one or more days, one or more weeks, and/or one or more months to pass.

Each of steps 1816 and 1818 can be accomplished by applying a force on an actuator of a valve such that the valve moves from the first position to the second position and the fluid contained within the fluid holding cavity drains from the fluid container and/or liner, through the passageway of the tubular member, and into the drain.

Each of steps 1810, 1812, 1814, 1816, and 1818 can be accomplished one or more times such that a fluid can be introduced into a fluid holding cavity one or more times.

Figure 43:
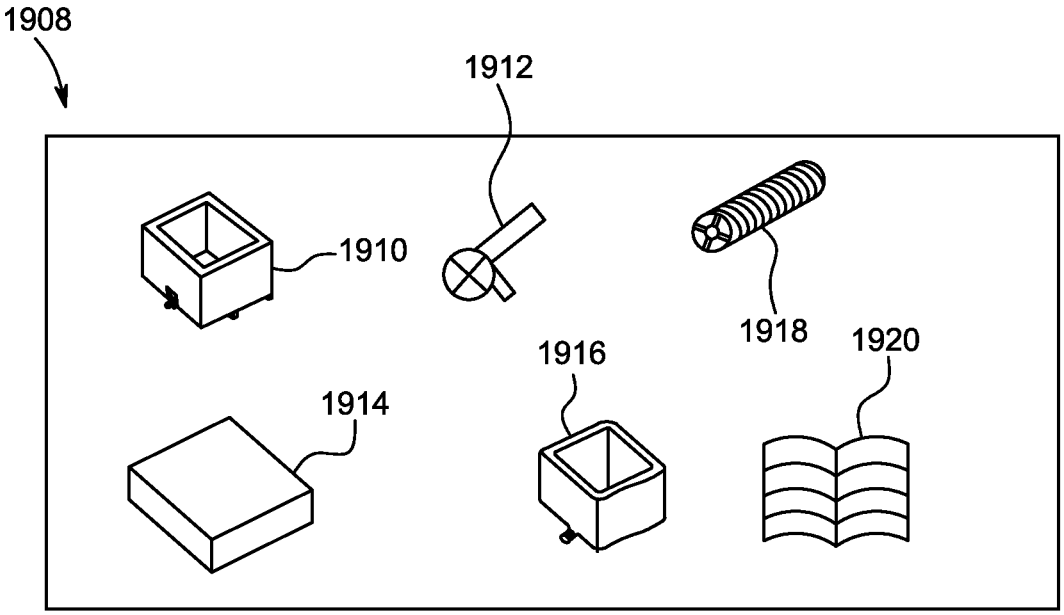
FIG. 43 illustrates an example kit that includes a fluid container.

FIG. 43 illustrates an exemplary kit 1908 comprising a fluid container 1910 according to an embodiment, such as fluid container 1010 illustrated in FIGS. 30, 31, 32, 33, 34, 35, and 36; a valve 1912 according to an embodiment, such as valve 1104 illustrated in FIGS. 30, 31, 32, 33, 34, 35, and 36; a lid 1914 according to an embodiment, such as lid 1106 illustrated in FIGS. 30, 31, 32, 33, 34, 35, and 36; a liner 1916 according to an embodiment, such as liner 1108 illustrated in FIGS. 30, 31, 32, 33, 34, 35, and 36; an attachment screw 1918 according to an embodiment, such as attachment screw 1110 illustrated in FIGS. 30, 31, 32, 33, 34, 35, and 36; and instructions for use 1920.

While kit 1908 has been illustrated as only including a single fluid container 1910, a single valve 1912, a single lid 1914, a single liner 1916, and a single attachment screw 1918, any suitable number of fluid containers, fluid container systems, valves, lids, liners, and/or attachment screws can be included in a kit. Selection of a suitable number of fluid containers, fluid container systems, valves, lids, liners, and/or attachment screws to include in a kit according to a particular embodiment can be based on various considerations, such as the intended use of the kit. Examples of suitable numbers of fluid containers, fluid container systems, valves, lids, liners, and/or attachment screws to include in a kit include at least one, one, two, a plurality, three, four, five, six, and any other number considered suitable for a particular embodiment.

Furthermore, while fluid container 1010, valve 1104, lid 1106, liner 1108, and attachment screw 1110 have been illustrated as included in kit 1908, any suitable fluid container, fluid container system, valve, lid, liner, and/or attachment screw can be included in a kit. Selection of a suitable fluid container, fluid container system, valve, lid, liner, and/or attachment screw to include in a kit according to a particular embodiment can be based on various considerations, such as the intended use of the kit. Examples of suitable fluid containers and fluid container systems that can be included in a kit include fluid container 10, fluid container 110, fluid container 210, fluid container 310, fluid container 510, fluid container 610, fluid container 710, fluid container system 808, fluid container system 1008, fluid container system 1308, fluid container 1410 and associated structure, fluid container 1510 and associated structure, fluid container 1610 and associated structure, variations of the fluid containers or fluid container systems described herein, and any other fluid container or fluid container system considered suitable for a particular embodiment. Examples of suitable valves that can be included in a kit include valve 904, valve 1104, valve 1512, variations of the valves described herein, and any other valve considered suitable for a particular embodiment. Examples of suitable lids that can be included in a kit include lid 906, lid 1106, lid 1412, variations of the lids described herein, and any other lid considered suitable for a particular embodiment. Examples of suitable liners that can be included in a kit include liner 1108, a plurality of liners 1210, variations of the liners described herein, and any other liner considered suitable for a particular embodiment. Examples of suitable attachment screws that can be included in a kit include attachment screw 1110, variations of the attachment screw described herein, and any other attachment screw considered suitable for a particular embodiment.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. A fluid container comprising:

a main body having a bottom wall and a sidewall, the bottom wall having a bottom wall first internal surface and a bottom wall second internal surface, the sidewall extending from the bottom wall and having a sidewall first internal surface, a sidewall second internal surface, and defining a passageway extending through the sidewall first internal surface, the sidewall first internal surface disposed at a first angle relative to the bottom wall first internal surface, the sidewall second internal surface disposed at a second angle relative to the bottom wall second internal surface, the second angle different than the first angle, the bottom wall second internal surface extending from the sidewall second internal surface to the bottom wall first internal surface, the bottom wall first internal surface extending from the bottom wall second internal surface at a downward slope, the bottom wall and the sidewall cooperatively defining a fluid holding cavity in fluid communication with the passageway; and a support leg extending from the main body.

2. The fluid container of claim 1, wherein the bottom wall first internal surface has a first width; and wherein the bottom wall second internal surface has a second width that is different than the first width.

3. The fluid container of claim 2, wherein the second width is greater than the first width.

4. The fluid container of claim 3, wherein the first width is disposed adjacent to the sidewall first internal surface; and wherein the second width is disposed adjacent to the sidewall second internal surface.

5. The fluid container of claim 1, wherein the bottom wall first internal surface is curved.

6. The fluid container of claim 1, wherein the bottom wall second internal surface extends from the sidewall second internal surface to the bottom wall first internal surface at a downward slope.

7. The fluid container of claim 1, wherein the bottom wall first internal surface extends from the bottom wall second internal surface to the sidewall first internal surface.

8. The fluid container of claim 1, wherein the bottom wall first internal surface is continuous and uninterrupted; and wherein the bottom wall second internal surface is continuous and uninterrupted.

9. The fluid container of claim 1, wherein the bottom wall first internal surface is disposed at a third angle relative to the bottom wall second internal surface that is greater than 90 degrees.

10. The fluid container of claim 1, wherein the bottom wall first internal surface is disposed at a third angle relative to the bottom wall second internal surface that is greater than 180 degrees.

11. The fluid container of claim 1, wherein the sidewall has a sidewall top end;

wherein the sidewall first internal surface has a first length that extends from the sidewall top end to the bottom wall; and wherein the sidewall second internal surface has a second length that extends from the sidewall top end to the bottom wall, the second length being different from the first length.

12. The fluid container of claim 11, wherein the first length is greater than the second length.

13. The fluid container of claim 1, wherein the second angle is greater than 90 degrees.

14. The fluid container of claim 1, further comprising a lid releasably attached to the main body.

15. The fluid container of claim 14, further comprising a liner releasably disposed within the fluid holding cavity, the liner defining a liner fluid holding cavity, a liner projection, and a liner passageway extending through the liner projection and in fluid communication with the liner fluid holding cavity, the liner projection disposed within the passageway defined by the fluid container.

16. The fluid container of claim 1, further comprising a valve attached to the main body and in fluid communication with the passageway.

17. The fluid container of claim 1, wherein the sidewall first internal surface is disposed substantially opposite the sidewall second internal surface across the fluid holding cavity.

18. The fluid container of claim 1, wherein the fluid holding cavity has a capacity that is greater than five gallons.

19. A fluid container comprising:

a main body having a bottom wall and a sidewall, the bottom wall having a bottom wall first internal surface and a bottom wall second internal surface, the sidewall extending from the bottom wall and having a sidewall first internal surface, a sidewall second internal surface, and defining a passageway extending through the sidewall first internal surface, the sidewall first internal surface disposed at a first angle relative to the bottom wall first internal surface, the sidewall second internal surface disposed at a second angle relative to the bottom wall second internal surface, the second angle different than the first angle, the bottom wall first internal surface having a first width, the bottom wall second internal surface extending from the sidewall second internal surface to the bottom wall first internal surface and having a second width that is greater than the first width, the bottom wall first internal surface being curved and extending from the bottom wall second internal surface at a downward slope, the bottom wall and the sidewall cooperatively defining a fluid holding cavity in fluid communication with the passageway; and a support leg extending from the main body.

20. A system comprising:

a plurality of fluid containers, each fluid container having:

a main body having a bottom wall and a sidewall, the bottom wall having a bottom wall first internal surface and a bottom wall second internal surface, the sidewall extending from the bottom wall and having a sidewall first internal surface, a sidewall second internal surface, and defining a passageway extending through the sidewall first internal surface, the sidewall first internal surface disposed at a first angle relative to the bottom wall first internal surface, the sidewall second internal surface disposed at a second angle relative to the bottom wall second internal surface, the second angle different than the first angle, the bottom wall second internal surface extending from the sidewall second internal surface to the bottom wall first internal surface, the bottom wall first internal surface extending from the bottom wall second internal surface at a downward slope, the bottom wall and the sidewall cooperatively defining a fluid holding cavity in fluid communication with the passageway; and a support leg extending from the main body; and a tubular member having a plurality of ends, a first end of the plurality of ends in communication with the fluid holding cavity of a first container of the plurality of fluid containers, a second end of the plurality of ends in communication with the fluid holding cavity of a second container of the plurality of fluid containers.

* * * * *